US006991879B2

(12) United States Patent
Hosoi et al.

(10) Patent No.: US 6,991,879 B2
(45) Date of Patent: Jan. 31, 2006

(54) ELECTROPHOTOGRAPHIC PHOTOSENSITIVE MEMBER

(75) Inventors: Kazuto Hosoi, Shizuoka (JP); Hideaki Matsuoka, Shizuoka (JP); Satoshi Kojima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 10/636,691

(22) Filed: Aug. 8, 2003

(65) Prior Publication Data

US 2004/0209179 A1 Oct. 21, 2004

(30) Foreign Application Priority Data

Aug. 9, 2002 (JP) ..... 2002-234187
Aug. 9, 2002 (JP) ..... 2002-234188

(51) Int. Cl.
*G03G 5/08* (2006.01)

(52) U.S. Cl. ..... 430/57.4; 430/56; 430/95

(58) Field of Classification Search ..... 430/57.4, 430/56, 95

See application file for complete search history.

(56) References Cited

U.S. PATENT DOCUMENTS

| | | | | |
|---|---|---|---|---|
| 4,579,797 A | | 4/1986 | Saitoh et al. | 430/57 |
| 4,758,487 A | * | 7/1988 | Stolka et al. | 430/57.4 |
| 5,106,711 A | | 4/1992 | Kawamura et al. | 430/56 |
| 5,258,250 A | | 11/1993 | Shirai et al. | 430/57 |
| 5,464,721 A | | 11/1995 | Yagi et al. | 430/126 |
| 5,516,611 A | | 5/1996 | Kojima et al. | 430/84 |
| 5,556,729 A | | 9/1996 | Fukuda et al. | 430/65 |
| 5,939,230 A | | 8/1999 | Kojima et al. | 430/57 |
| 6,379,852 B2 | | 4/2002 | Tsuchida et al. | 430/57.7 |
| 2002/0168859 A1 | | 11/2002 | Ehara et al. | 438/694 |
| 2003/0143478 A1 | | 7/2003 | Niino et al. | 430/128 |

FOREIGN PATENT DOCUMENTS

| | | |
|---|---|---|
| EP | 0 619 526 A2 | 10/1994 |
| JP | 57-115556 | 7/1982 |
| JP | 61-289354 | 12/1986 |
| JP | 6-83090 | 3/1994 |
| JP | 6-242623 | 9/1994 |

OTHER PUBLICATIONS

Curtins, et al.; "Influence of Plasma Excitation Frequency for a-Si:H Thin Film Deposition"; Plasma Chemistry and Plasma Processing, vol. 7, No. 3, 1987, 267-273.

* cited by examiner

*Primary Examiner*—John L Goodrow
(74) *Attorney, Agent, or Firm*—Fitzpatrick, Cella, Harper & Scinto

(57) ABSTRACT

In an electrophotographic photosensitive member comprising a conductive substrate, and provided thereon a photoconductive layer containing at least an amorphous material composed chiefly of silicon atoms and, deposited on the photoconductive layer, a layer region containing an amorphous material composed chiefly of silicon atoms, which layer region contains at least partly a periodic-table Group 13 element, the content of the periodic-table Group 13 element based on the total amount of constituent atoms in the layer region deposited on the photoconductive layer has distribution having at least any two of maximum value(s) and maximum region(s) in the thickness direction of the layer region. This electrophotographic photosensitive member can be improved in charging performance, can prevent image defects due to pressure mars and can form high-quality images over a long period of time.

16 Claims, 9 Drawing Sheets

ELECTROPHOTOGRAPHIC PHOTOSENSITIVE MEMBER

BACKGROUND OF THE INVENTION

1. Field of the Invention

This invention relates to an electrophotographic photosensitive member having a sensitivity to electromagnetic waves such as light (which herein refers to light in a broad sense and indicates ultraviolet rays, visible rays, infrared rays, X-rays, Y-rays and so forth).

2. Related Background Art

In the field of image formation, photoconductive materials that form light-receiving layers in light-receiving members such as electrophotographic photosensitive members are required to have properties as follows: They are highly sensitive, have a high SN ratio [photo-current (Ip)/dark current (Id)], have absorption spectra suited to spectral characteristics of electromagnetic waves to be applied, have a high response to light, have the desired dark resistance value and are harmless to human bodies when used. In particular, in the case of electrophotographic photosensitive members set in electrophotographic apparatus used as business machines in offices, the harmlessness in their use is an important point.

The Photoconductive materials having good properties in these respects include amorphous silicon, and have attracted notice as light-receiving layers of electrophotographic photosensitive members.

For such light-receiving members, it is common to form photoconductive layers comprised of a-Si, by film-forming processes such as vacuum deposition, sputtering, ion plating, thermal CVD, photo-assisted CVD and plasma-assisted CVD, which layers are formed on conductive supports while heating the supports at 50° C. to 350° C. In particular, their formation by the plasma-assisted CVD is preferable and has been put into practical use; the plasma-assisted CVD, that is, a process in which source gases are decomposed by high-frequency or microwave glow discharging to form a-Si deposited films on the support.

For example, Japanese Patent Application Laid-Open No. 57-115556 discloses a technique in which a surface barrier layer formed of a non-photoconductive amorphous material containing silicon atoms and carbon atoms is provided on a photoconductive layer formed of an amorphous material composed chiefly of silicon atoms, in order to achieve improvements in electrical, optical and photoconductive properties such as dark resistance, photosensitivity and response to light and service environmental properties such as moisture resistance and also in stability with time, of a photoconductive member having a photoconductive layer constituted of an a-Si deposited film.

Japanese Patent Application Laid-Open No. 6-83090 (corresponding to U.S. Pat. No. 5,464,721) also discloses a contact-charging, negative-charging electrophotographic photosensitive member provided on a photoconductive layer with a charge-trapping layer and a charge injection blocking layer which are formed of a doped a-Si, in order to perform sufficient charging even at the time of high humidity.

Japanese Patent Application Laid-Open No. 6-242623 (corresponding to U.S. Pat. No. 5,556,729) still also discloses a technique in which a hole-capturing layer composed chiefly of amorphous silicon and also containing less than 50 ppm of boron or not containing any element which governs the conductivity is provided between a photoconductive layer and a surface protective layer of a negative-charging electrophotographic photosensitive member to achieve superior electrophotographic performance.

The above techniques have brought improvements in electrical, optical and photoconductive characteristics and service environmental properties, and, with such improvements, have brought an improvement in image quality.

Moreover, in recent years, there are strong desires for improvements in film quality and processability, and measures therefor are studied in variety.

In particular, a plasma-assisted process making use of high-frequency power is widely used because of its various advantages such that it has a high discharge stability and can be used to form insulating materials such as oxide films and nitride films.

In recent years, plasma-assisted CVD carried out at a high frequency of 50 MHz or above using a parallel flat plate type plasma-assisted CVD apparatus, as reported in Plasma Chemistry and Plasma Processing, Vol. 7, No. 3 (1987), pp.267 to 273, has attracted notice, which shows a possibility of improving the deposition rate without a lowering of the performance of deposited films by making the discharge frequency higher than 13.56 MHz conventionally used. Making the discharge frequency higher in this way is also reported in respect of sputtering, and is widely studied in recent years.

When a-Si photosensitive members produced by these processes are applied to electrophotographic apparatus, as charging and charge-eliminating means, corona assemblies (Corotron, Scorotron) are used which have a wire electrode (a metal wire such as a tungsten wire of 50 to 100 $\mu$m diameter, coated with gold) and a shielding plate as chief constituent members in almost all cases. More specifically, corona electric currents generated by applying a high voltage (about 4 to 8 kV) to the wire electrode of a corona assembly are made to act on the surface of the photosensitive member to charge its surface and eliminate charges therefrom. Corona assemblies are superior in uniform charging and charge elimination.

However, corona discharge is accompanied with generation of ozone ($O_3$), which oxidizes nitrogen in the air to produce nitrogen oxides ($NO_x$). The nitrogen oxides thus produced further react with water in air to produce nitric acid and so forth. Then, corona discharge products such as nitrogen oxides and nitric acid may adhere to and deposit on the photosensitive member and its surrounding machinery to contaminate their surfaces.

Such corona discharge products have so strong moisture absorption that the photosensitive member surface having adsorbed them comes to have a low resistance because of the moisture absorption of the corona discharge products having adhered thereto, so that the ability of charge retention may substantially lower on the whole or in part to cause image defects such as faint images and smeared images (the electric charges on the surface of the photosensitive member leak in the surface direction to cause deformation, or no formation, of patterns of electrostatic latent images).

Corona discharge products having adhered to the inner surface of the shielding plate of the corona assembly also evaporate and become liberated not only while the electrophotographic apparatus is driven but also while the apparatus is in pause, e.g., at night. Such products adhere to the surface of the photosensitive member at its part corresponding to the discharge opening of the charging assembly to cause further moisture absorption and make the surface of the a-Si photosensitive member have a low resistance. Hence, the first copy initially put out when the apparatus is again driven after a pause of the apparatus, or copies on several sheets subsequent thereto, tend(s) to have smeared images occurring at the area corresponding to the discharge opening that has stood while the apparatus had been in pause. This tends to occur especially when the corona assembly is an AC corona assembly.

Accordingly, a method is available in which a heater for heating the the a-Si photosensitive member is built in the a-Si photosensitive member or warm air is blown on the a-Si photosensitive member by means of a warm-air blower to heat the surface of the a-Si photosensitive member (to 30 to 50° C.) to lower relative humidity. This method is a measure by which the corona discharge products and water content having adhered to the surface of the a-Si photosensitive member are made to volatilize to keep its surface from coming to have low resistance substantially, and has been put into practical use.

As another technique, as disclosed in Japanese Patent Application Laid-Open No. 61-289354, a method is also available in which, in order to keep the initial-stage smeared images from occurring, the surface of the a-Si photosensitive member is made to have an improved water repellency to keep the corona discharge products and water content from adhering to the surface of the a-Si photosensitive member, and has been put into practical use.

As a means for removing the corona discharge products and water content having adhered to the surface of the a-Si photosensitive member, also employed are a cleaning system making use of a magnet roller having a high cleaning ability and a cleaning system making use of a blade.

However, with regard to such a blade type cleaning system, its cleaning performance depends greatly on the slipperiness of the surface of the a-Si photosensitive member. Especially in the field of high-speed copying machines or in the field of laser beam printers or the like, copies or prints are made on a large number of sheets over a long period of time with higher frequencies than usual copying machines. If any a-Si photosensitive members with poor surface slipperiness are used in such copying machines or printers, they have so high frictional resistance to a cleaning blade that the blade can not withstand their long-term service to deteriorate greatly on and on, so that the residual developer (toner) may slip through to cause faulty cleaning in black stripes.

On the other hand, in a-Si photosensitive members with good surface slipperiness, their surface layers may have a tendency to wear greatly to shorten the lifetime of the a-Si photosensitive member.

Such high frictional resistance of the surface of the a-Si photosensitive member may also increase frictional heat between the surface of the a-Si photosensitive member and the cleaning blade to cause a phenomenon of melt adhesion that any residual developer involved in heat fixing adheres toughly to the surface of the a-Si photosensitive member because of this frictional heat. This phenomenon of melt adhesion is slight enough not to affect images at the initial stage, but minute deposits caused by melt adhesion serve as nuclei from which they grow gradually with repeated service to become causes of image defects such as black dots, white dots, black-line blank areas and white-line blank areas appearing on images.

Accordingly, it has become important to prevent the smeared images and the faulty cleaning and also to keep the surface of the a-Si photosensitive member from wearing.

The conventional photosensitive members constituted of a-Si materials have individually been improved in properties in respect of electrical, optical and photoconductive properties such as dark resistance, photosensitivity and response to light as well as service environmental properties and running performance. However, it is actual circumstances that there is room for further improvements in order to achieve overall improvements in properties.

In recent years, with spread of computers and advance of networks in offices, electrophotographic apparatus are not only used as conventional analog copying machines but also now sought to be made digital so that they can play a role as facsimile machines or printers. Moreover, digital full-color copying machines for full-color reproducing digitized information are demanded. Thus, an electrophotographic photosensitive member that can meet such demands are earnestly desired.

In digital full-color copying machines, a negative toner having a wide range of material selection as a toner and an image exposure method (method in which images areas are exposed to light), having a high latent-image controllability and readily achievable of high image quality, are considered to be most common combination for charging, development and so forth. In such a case, it is necessary for the photosensitive member to be charged with negative electric charges. Negative-charging a-Si photosensitive members may preferably be provided with an upper-part charge injection blocking layer in order to block as far as possible the injection of negative electric charges from the surface. How this upper-part charge injection blocking layer be improved holds the key to improvement in properties and characteristics. In particular, to meet a demand for digital full-color copying machines, it has become necessary to make overall improvements in photosensitive member performances. For example, as one of process conditions, a plurality of developing assemblies are provided around one electrophotographic photosensitive member, or a large-size developing means is used. Hence, the machine may have construction where the distance from a charging assembly to a developing assembly tends to be large. Accordingly, the charge potential must be made higher than ever in order to compensate any lowering of potential coming from the charging assembly to the developing assembly, and the upper-part charge injection blocking layer has become important more and more.

In addition, the trend toward higher image quality of the digital full-color copying machines have raised the level of a demand for image quality, and has reached a situation that image defects of an extent that has been tolerated in conventional-type apparatus must be questioned. For example, depending on conditions for producing negative-charging a-Si photosensitive members in which the upper-part charge injection blocking layer is formed, image defects called "pressure mar marks" may appear when a high load is applied to a minute area of the surface of an photosensitive member having been produced. This is a phenomenon that, although any mars (pressure mars) are not seen in appearance at all on a photosensitive member surface when the surface of the photosensitive member is scratched with a diamond needle of 0.8 mm in diameter as tip diameter under application of a load, the ability to retain-dark potential lowers greatly at the part thus scratched, to cause image defects on images.

Such pressure mar marks tend to be conspicuous especially on halftone images. Also, slight pressure mars may varnish upon heating the photosensitive member for about 1 hour at 200° C. to 240° C. However, if the pressure mars have formed in the market, such a measure is impossible to take, and also it is difficult to predict the occurrence of pressure mars.

In addition, as stated previously, in the case when the surface of the a-Si photosensitive member has a high frictional resistance, such high frictional resistance may increase frictional heat between the surface of the a-Si photosensitive member and the cleaning blade to cause the phenomenon of melt adhesion that any residual developer involved in heat fixing adheres toughly to the surface of the a-Si photosensitive member because of this frictional heat. This phenomenon of melt adhesion is slight enough not to affect images at the initial stage, but minute deposits caused by melt adhesion serve as nuclei from which they grow gradually with repeated service to become causes of image defects such as black dots, white dots, black-line blank areas and white-line blank areas appearing on images.

Accordingly, it has become important to prevent the smeared images and the faulty cleaning and also to keep the surface of the a-Si photosensitive member from wearing.

Moreover, problems as discussed below have newly come to pass.

Developers (color toners) used in digital full-color copying machines are non-magnetic toners not containing any magnetic material, where any cleaning system using a magnet roller can not be used. Hence, it has come necessary to effectively bring out the cleaning ability the cleaning blade has.

Image defects in black spots or white spots, i.e., image defects called "dots" are put to severer standards year by year, and images are treated as being poor in some cases even when only few dots are present in an A3-size sheet, depending on their size. Moreover, where electrophotographic photosensitive members are set in color copying machines which are digital copying machines, the standards have come much severer, and images are treated as being poor in some cases even when only one dot is present in an A3-size sheet. Accordingly, an a-Si photosensitive member is desired which may much less cause image defects.

Thus, the upper-part charge injection blocking layer formed in the conventional negative-charging a-Si photosensitive members is an important part which influences electrophotographic performances, and is demanded to be more improved in regard to the matching with electrophotographic apparatus.

SUMMARY OF THE INVENTION

The present invention is to solve the above problems. Accordingly, an object of the present invention is to provide an electrophotographic photosensitive member which has materialized an improvement in charging performance, has overcome the problems of occurrence of image defects due to pressure mars to elongate the lifetime of a-Si photosensitive members and can obtain good images free of image defects over a long period of time.

To achieve the above objects, the present invention provides an electrophotographic photosensitive member comprising a conductive substrate, and provided thereon:

a photoconductive layer containing at least an amorphous material composed chiefly of silicon atoms and;

deposited on the photoconductive layer, a layer region containing an amorphous material composed chiefly of silicon atoms, which layer region contains at least partly a periodic-table Group 13 element, wherein;

the content of the periodic-table Group 13 element based on the total amount of constituent atoms in-the layer region deposited on the photoconductive layer has distribution having at least any two of maximum value(s) and maximum region(s) in the thickness direction of the layer region.

The present invention also provides an electrophotographic photosensitive member comprising a conductive substrate, and provided thereon:

a photoconductive layer containing at least an amorphous material composed chiefly of silicon atoms and;

deposited on the photoconductive layer, a layer region containing an amorphous material composed chiefly of silicon atoms, which layer region contains at least partly a periodic-table Group 13 element and carbon atoms, wherein;

the content of the carbon atoms based on the total amount of constituent atoms in the layer region deposited on the photoconductive layer has distribution having at least any two of maximum value(s) and maximum region(s) in the thickness direction of the layer region.

DESCRIPTION OF THE PREFERRED EMBODIMENTS

Figure 1:
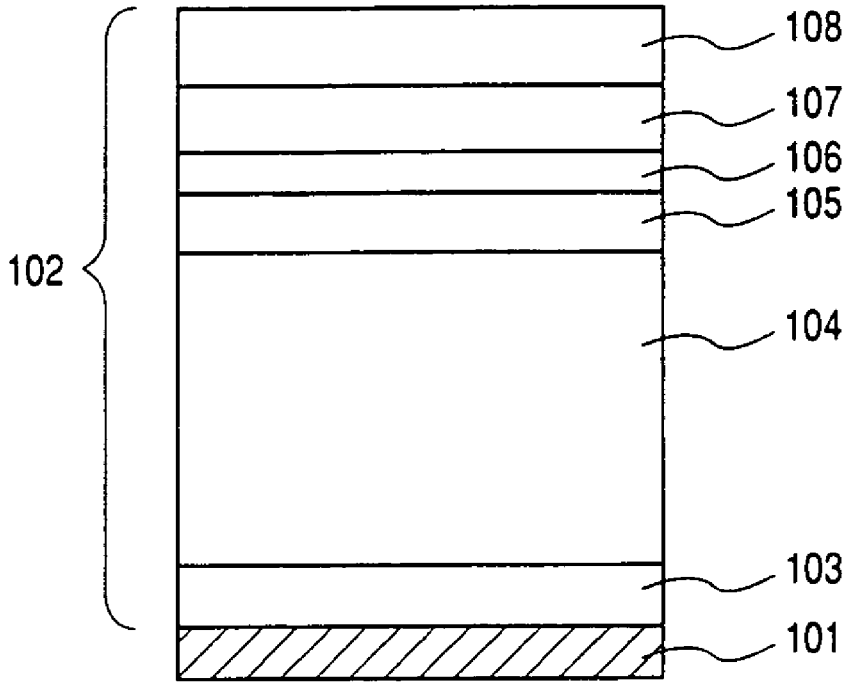
FIG. 1 is a diagrammatic sectional view to illustrate an example of the structure of the electrophotographic photosensitive member of the present invention.

In regard to the improvement of a-Si photosensitive members and the pressure mars, the present inventors have examined the role, construction, and matching of layer construction in upper-part charge injection blocking layers over various conditions. As the result, they have discovered that the content of a periodic-table Group 13 element based on the total amount of constituent atoms in an amorphous-silicon layer region may have distribution having at least any two of maximum value(s) and maximum region(s) in the thickness direction of the amorphous-silicon layer region and this can bring an improvement in charging performance and keep the pressure mars from forming. Thus, they have accomplished the present invention.

More specifically, the present invention is as follows:

The present invention is an electrophotographic photosensitive member comprising a conductive substrate, and provided thereon a photoconductive layer containing at least an amorphous material composed chiefly of silicon atoms and, deposited on the photoconductive layer, a layer region containing an amorphous material composed chiefly of silicon atoms, which layer region contains at least partly a periodic-table Group 13 element; in which the content of the periodic-table Group 13 element based on the total amount of constituent atoms in the amorphous-material-containing layer region deposited on the photoconductive layer has distribution having at least any two of maximum value(s) and maximum region(s) in the thickness direction of the layer region. The thickness direction of the layer region refers to a plane perdendicular to the plane constituting the layer region.

The wording "at least any two of maximum value(s) and maximum region(s)" herein used refers to, for example, any combination of the following:

(i) at least two maximum values;

(ii) at least two maximum regions; and (iii) at least one maximum value and at least one maximum region.

The present invention may also be the above electrophotographic photosensitive member, which contains at least one kind of atoms selected from carbon atoms, oxygen atoms and nitrogen atoms in the amorphous-material-containing layer region deposited on the photoconductive layer.

The present invention may still also be the above electrophotographic photosensitive member, in which, in the amorphous-material-containing layer region deposited on the photoconductive layer, an outermost surface layer is formed of an amorphous material composed chiefly of silicon atoms and containing carbon atoms.

The present invention may further be the above electrophotographic photosensitive member, in which, in the amorphous-material-containing layer region deposited on the photoconductive layer, the distance between any two of maximum value(s) and maximum region(s) adjacent to each other of the periodic-table Group 13 element content based on the total amount of constituent atoms is in the range of from 100 nm or more to 1,000 nm or less in the thickness direction of the layer region.

The present invention may still further be the above electrophotographic photosensitive member, in which, in the amorphous-material-containing layer region deposited on the photoconductive layer, the periodic-table Group 13 element content based on the total amount of constituent atoms has a maximum value or maximum region value of 100 atomic ppm or more, and has a minimum value of 50 atomic ppm or less which is present between any two of maximum value(s) and maximum region(s) adjacent to each other. Herein, the "minimum value" refers to a value which is smallest among the values of the periodic-table Group 13 element content that are present between any of maximum value(s) and maximum region(s). For example, where three or more maximum values are present, it refers to a value which is smallest among two or more minimum values of the periodic-table Group 13 element content that are present between the maximum values.

The present invention may still further be the above electrophotographic photosensitive member, in which, in the amorphous-material-containing layer region deposited on the photoconductive layer, a maximum value or maximum region value positioned on the outermost surface side is largest among the maximum value(s) and maximum region(s) of the periodic-table Group 13 element content based on the total amount of constituent atoms.

In another embodiment, the present invention is an electrophotographic photosensitive member comprising a conductive substrate, and provided thereon a photoconductive layer containing at least an amorphous material composed chiefly of silicon atoms and, deposited on the photoconductive layer, a layer region containing an amorphous material composed chiefly of silicon atoms, which layer region contains at least partly a periodic-table Group 13 element and carbon atoms; in which the content of the carbon atoms based on the total amount of constituent atoms in the amorphous-material-containing layer region deposited on the photoconductive layer has distribution having at least any two of maximum value(s) and maximum region(s) in the thickness direction of the layer region. The thickness direction of the amorphous-material-containing layer region represents a plane perpendicular to the plane constituting the layer region.

The above electrophotographic photosensitive member of the present invention may also preferably be an electrophotographic photosensitive member in which, in the amorphous-material-containing-layer region deposited on the photoconductive layer, an outermost surface layer is formed of an amorphous material composed chiefly of silicon atoms and containing carbon atoms.

The above electrophotographic photosensitive member of the present invention may still also preferably be an electrophotographic photosensitive member in which, in the amorphous-material-containing layer region deposited on the photoconductive layer, the carbon atom content based on the total amount of constituent atoms has a maximum value or maximum region value in the range of from 40 atomic % or more to 95 atomic % or less.

The above electrophotographic photosensitive member of the present invention may still also preferably be an electrophotographic photosensitive member in which, in the amorphous-material-containing layer region deposited on the photoconductive layer, the distance between any two of maximum value(s) and maximum region(s) adjacent to each other of the carbon atom content based on the total amount of constituent atoms is in the range of from 100 nm or more to 3,000 nm or less.

The above electrophotographic photosensitive member of the present invention may further preferably be an electrophotographic photosensitive member in which, in the amorphous-material-containing layer region deposited on the photoconductive layer, a maximum value or maximum region value positioned on the outermost surface side is largest among the maximum value(s) and maximum region(s) of the carbon atom content based on the total amount of constituent atoms.

The above electrophotographic photosensitive member of the present invention may still further preferably be an electrophotographic photosensitive member in which, in the amorphous-material-containing layer region deposited on the photoconductive layer, the content of the periodic-table Group 13 element based on the total amount of constituent atoms has distribution having at least any two of maximum value(s) and maximum region(s) in the thickness direction of the layer region.

The above electrophotographic photosensitive member of the present invention may still further preferably be an electrophotographic photosensitive member in which, in the amorphous-material-containing layer region deposited on the photoconductive layer, the distance between any two of maximum value(s) and maximum region(s) adjacent to each other of the periodic-table Group 13 element content based on the total amount of constituent atoms is in the range of from 100 nm or more to 1,000 nm or less.

The above electrophotographic photosensitive member of the present invention may still further preferably be an electrophotographic photosensitive member in which, in the amorphous-material-containing layer region deposited on the photoconductive layer, the periodic-table Group 13 element content based on the total amount of constituent atoms has a maximum value or maximum region value of 100 atomic ppm or more, and has a minimum value of 50 atomic ppm or less which is present between any two of maximum value(s) and maximum region(s) adjacent to each other. Herein, the "minimum value" refers to a value which is smallest among the values of the periodic-table Group 13 element content that are present between any of maximum value(s) and maximum region(s). For example, where three or more maximum values are present, it refers to a value which is smallest among two or more minimum values of the periodic-table Group 13 element content that are present between the maximum values.

The above electrophotographic photosensitive member of the present invention may still further preferably be an electrophotographic photosensitive member in which, in the amorphous-material-containing layer region deposited on the photoconductive layer, a maximum value or maximum region value positioned on the outermost surface side is largest among the maximum value(s) and maximum region value(s) of the periodic-table Group 13 element content based on the total amount of constituent atoms.

The above electrophotographic photosensitive member of the present invention may still further preferably be an electrophotographic photosensitive member in which, in the amorphous-material-containing layer region deposited on the photoconductive layer, the maximum value(s) or maximum region(s) of the carbon atom content based on the total amount of constituent atoms and the maximum value(s) or maximum region(s) of the periodic-table Group 13 element content based on the total amount of constituent atoms are alternately distributed in the thickness direction of the layer region.

Figure 4A:
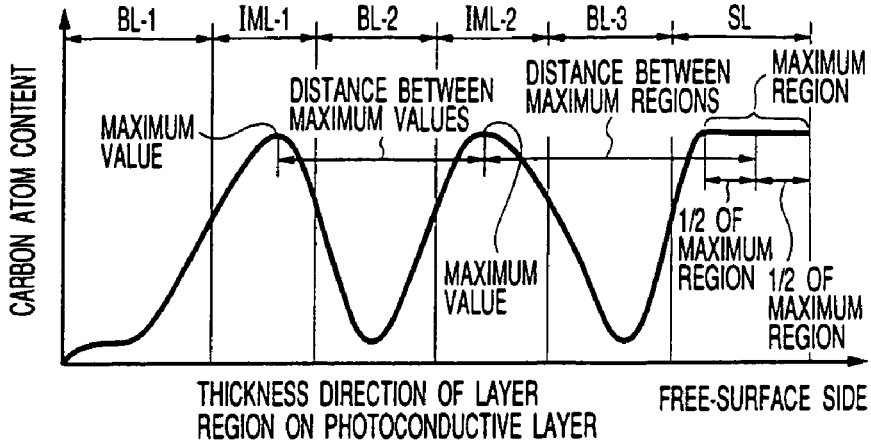
FIGS. 4A, 4B and 4C show distribution curves of the carbon atom content in the thickness direction of an amorphous-silicon layer region of an a-Si photosensitive member of the present invention.

The maximum region referred to in the present invention is meant to be a region in which, as shown in FIG. 4A, the content of atoms in a layer (in this case, carbon atoms) does not have any maximum value but is larger than their content in a directly underlying layer (in this case, an upper-part charge injection blocking layer) and is constant. The maximum region value is also meant to be the content of atoms (in this case, carbon atoms) at the position of ½ of the maximum region in its thickness direction. The distance between the maximum regions is meant to be the distance between the two maximum region values in their thickness direction. The distance between the maximum region value in its thickness direction and the maximum value is also regarded as the distance between the maximum regions.

The present invention is described below in detail.

Amorphous-silicon (a-Si) Photosensitive Member According to the Present Invention The a-Si photosensitive member may have layer construction with a plurality of layers. For example, a first upper-part charge injection blocking layer 105, an intermediate layer 106, a second upper-part charge injection blocking layer 107 and a surface protective layer 108 may be provided on a photoconductive layer. Incidentally, the content of each element such as carbon, oxygen, nitrogen, silicon, a periodic-table Group 13 element, hydrogen or a halogen is measured by secondary ion mass spectroscopy (SIMS), and is determined by calculating the proportion of the carbon, oxygen, nitrogen, silicon, periodic-table Group 13 element, hydrogen or halogen atoms to the total amount of atoms constituting the above first upper-part charge injection blocking layer 105, intermediate layer 106, second upper-part charge injection blocking layer 107 and surface protective layer 108 that make up the layer region.

FIG. 1 is a diagrammatic sectional view to illustrate an example of preferable layer-construction of the electrophotographic photosensitive member of the present invention.

In the electrophotographic photosensitive member shown in FIG. 1, a photosensitive layer 102 is provided on a conductive substrate 101. The photosensitive layer 102 consists of an amorphous lower-part charge injection blocking layer 103 composed chiefly of silicon atoms, an amorphous photoconductive layer 104 composed chiefly of silicon atoms, and, provided on the photoconductive layer 104, the first upper-part charge injection blocking layer 105, intermediate layer 106, second upper-part charge injection blocking layer 107 and surface protective layer 108 according to the present invention, which are provided in this order.

In the present invention, the first upper-part charge injection blocking layer 105 and the second upper-part charge injection blocking layer 107 are an amorphous layer composed chiefly of silicon atoms and optionally containing carbon, nitrogen and/or oxygen. The first upper-part charge injection blocking layer 105 and the second upper-part charge injection blocking layer 107 are further incorporated with a periodic-table Group 13 element under selection. The periodic-table Group 13 element may specifically include boron (B), aluminum (Al), gallium (Ga), indium (In) and thallium (Tl). In particular, B or Al is preferred.

Figure 2:
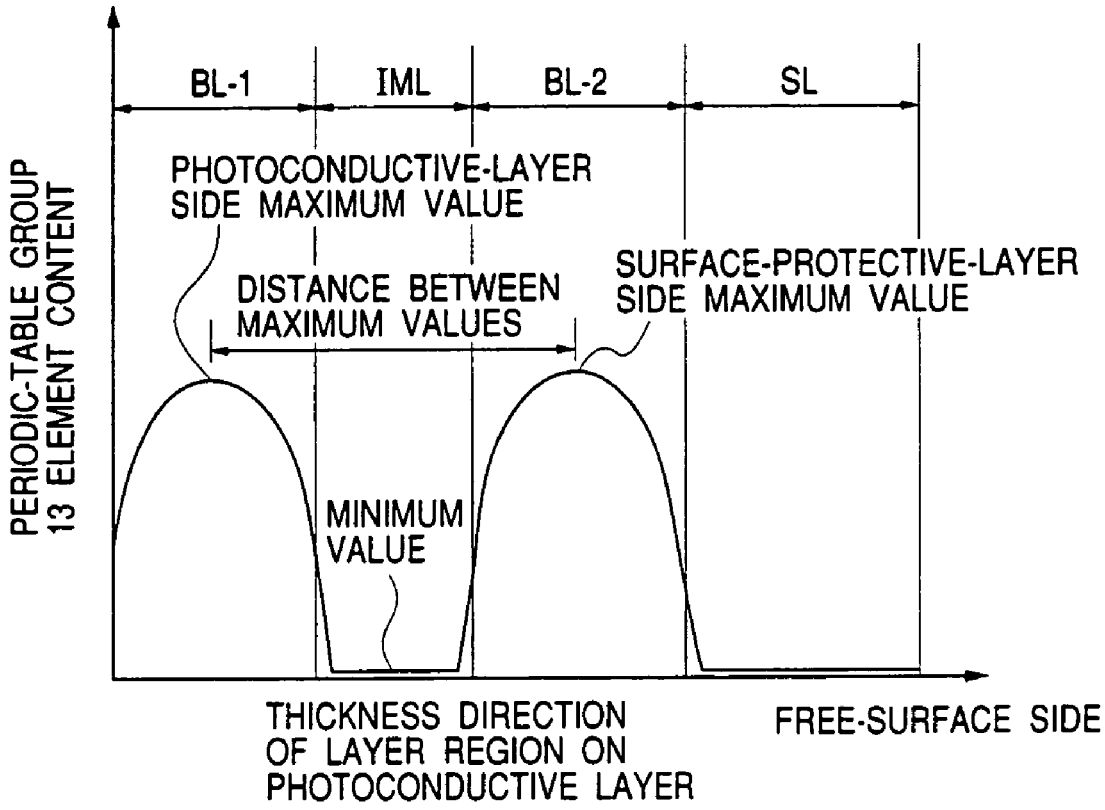
FIG. 2 shows a distribution curve of the periodic-table Group 13 element content in the thickness direction of an amorphous-silicon layer region of the electrophotographic photosensitive member of the present invention.

The intermediate layer 106, which is amorphous and composed chiefly of silicon atoms without being incorporated with any periodic-table Group 13 element, is also formed between the first upper-part charge injection blocking layer 105 and the second upper-part charge injection blocking layer 107. Thus, the content of the periodic-table Group 13 element has distribution as shown in FIG. 2, having two maximum values in the thickness direction of the amorphous layer. Here, the content of the periodic-table Group 13 element may be changed by changing the feed rate of a source gas for incorporating the Group 13 element, containing a source material of the Group 13 element, thus the maximum values can be obtained.

The maximum value(s) or maximum region(s) in the thickness direction of the layer containing the amorphous material may be formed in three or more. In such a case, three or more charge injection blocking layers may be provided. It is also preferable that a maximum value or maximum region value positioned on the outermost surface side is largest among the maximum value(s) and maximum region value(s) of the periodic-table Group 13 element content.

The first upper-part charge injection blocking layer 105, the intermediate layer 106 and the second upper-part charge injection blocking layer 107 are so formed that the periodic-table Group 13 element content has at least any two of maximum value(s) and maximum region(s) in the thickness direction of the layer containing the amorphous material. This enables dispersion of a load applied to the photosensitive member inwards from its surface, to make it possible to keep the pressure mars from forming. In addition, it has been found that, as the result of making the periodic-table Group 13 element content have, e.g., two maximum values in the thickness direction of the layer containing the amorphous material, the ability to block the injection of electric charges from the outermost surface can be more improved to bring an improvement in charging performance.

The intermediate layer 106 in the present invention comprises an amorphous layer composed chiefly of silicon atoms and optionally containing at least one of carbon, nitrogen and oxygen relatively in a large quantity. The intermediate layer 106 may also be changed in layer thickness, and this enables control of the distance between any two of maximum value(s) and maximum region(s) adjacent to each other of the periodic-table Group 13 element content in the thickness direction. In order to improve charging performance and keep pressure mars from forming, this distance may preferably be from 100 nm or more to 1,000 nm or less, more preferably from 200 nm or more to 800 nm or less, and still more preferably from 300 nm or more to 600 nm or less.

In the intermediate layer in the present invention, carbon atoms are incorporated in a large quantity. This has enabled formation of a smooth outermost surface layer in virtue of the covering effect of leveling surface unevenness when the first upper-part charge injection blocking layer is deposited.

It has also been found that the foregoing also brings the effect of achieving an improvement in adherence between the first upper-part charge injection blocking layer, the intermediate layer and the second upper-part charge injection blocking layer.

As to the two maximum values of the periodic-table Group 13 element content in the thickness direction and the minimum value of the periodic-table Group 13 element content, present between the two adjoining maximum values, which are as shown in FIG. 2, the maximum values and the minimum value may be controlled by changing the content of the periodic-table Group 13 element to be incorporated in the first upper-part charge injection blocking layer 105, second upper-part charge injection blocking layer 107 and intermediate layer 106. Further, the two maximum values may each be 100 atomic ppm or more and the minimum value between the maximum values may be 50 atomic ppm or less. This is preferable from the viewpoints of photosensitive member characteristics such as sufficient sensitivity and sufficient control of photomemory. More preferably, the maximum values may each be 200 atomic ppm or more, and still more preferably 300 atomic ppm or more. The minimum value between the maximum values may preferably be 40 atomic ppm or less, and more preferably be 30 atomic ppm or less. The two maximum values may also be made largest on the surface layer side. This is preferable from the viewpoints of keeping pressure mars from forming and improving charging performance and further achieving sufficient characteristics of photosensitive member such as sensitivity and photomemory.

The surface protective layer 108 formed on the second upper-part charge injection blocking layer 107 also comprises an amorphous layer composed chiefly of silicon atoms and optionally containing at least one of carbon, nitrogen and oxygen relatively in a large quantity. This layer enables improvement in environmental resistance, wear resistance and scratch resistance.

Since the amorphous-material-containing layer region of the present invention is so constructed that the content of the periodic-table Group 13 element based on the total amount of constituent atoms has at least any two of maximum value(s) and maximum region(s) in the thickness direction of the amorphous-material-containing layer region, the covering effect of leveling any unevenness of the intermediate layer can be obtained, and the surface protective layer having superior wear resistance can be formed. This has enabled an improvement in cleaning performance, smeared image proofness and wear resistance.

Changing the layer thickness of the surface protective layer and that of the second upper-part charge injection blocking layer also enables control of the distance between any two of maximum value(s) and maximum region(s) adjacent to each other of the carbon atom content in the thickness direction of the amorphous-material-containing layer region. For example, where the distance between the maximum regions is controlled to be 100 nm or more, the second upper-part charge injection blocking layer can be made to have an appropriate layer thickness, and hence any lowering of charging performance does not occur that is due to any small thickness of the second upper-part charge injection blocking layer. Also, where the distance between the maximum regions is 30,000 nm or less, any lowering of sensitivity does not occur that is due to excessive large thickness of the second upper-part charge injection blocking layer. More preferably, the distance between the maximum regions may be from 500 nm or more to 2,000 nm or less.

Substrate

As materials for the substrate, conductive materials such as aluminum and stainless steel are commonly used. Also usable are, e.g., materials not particularly having any conductivity, such as plastic and glass of various types, but provided with conductivity by vacuum deposition or the like of a conductive material on their surfaces at least on the side where the light-receiving layer is formed.

The conductive material may include, besides the foregoing, metals such as Cr, Mo, Au, In, Nb, Te, V, Ti, Pt, Pd and Fe, and alloys of any of these.

The plastic may include films or sheets of polyester, polyethylene, polycarbonate, cellulose acetate, polypropylene, polyvinyl chloride, polystyrene or polyamide.

The surface of the substrate such as a cylindrical conductive substrate is worked by means of a lathe or the like, and the substrate surface is degreased and cleaned before the step of film formation to form deposited films on the substrate. For the purpose of lessening image defects and achieving improvements in electrophotographic performances such as charging performance and photosensitivity, an Al—Si—O film (silicate film) which is formed using a water-based detergent prepared by dissolving a silicate as a corrosion preventive agent (inhibitor) may preferably further be formed on the substrate surface.

The silicate film formed on the Al substrate may preferably be in a layer thickness of from 0.5 nm or more, more preferably 1 nm or more, and still more preferably 1.5 nm or more, from the viewpoint of securing a sufficient effect of the film. On the other hand, from the viewpoint of securing sufficient conductivity of the substrate, it may preferably be in a layer thickness of from 15 nm or less, more preferably 13 nm or less, and still more preferably 12 nm or less.

Lower-part Charge Injection Blocking Layer

In the present invention, it is effective to provide on the conductive substrate 101 the lower-part charge injection blocking layer 103, which has the action to block the injection of electric charges from the substrate 101 side. The lower-part charge injection blocking layer 103 has the function to prevent electric charges from being injected from the substrate 101 side to the photoconductive layer 104 side when the light-receiving layer 102 is treated on its free surface by charging to a stated polarity.

The lower-part charge injection blocking layer 103 is composed chiefly of silicon atoms and incorporated with an element capable of controlling conductivity, relatively in a large quantity compared with the photoconductive layer 104. As the element capable of controlling conductivity which is to be incorporated in the lower-part charge injection blocking layer 103, a periodic-table Group 13 element may be used. In the present invention, the content of the periodic-table Group 13 element content to be incorporated in the lower-part charge injection blocking layer 103 may appropriately be determined as desired so that the object of the present invention can effectively be achieved. It may preferably be in a content of from 10 atomic ppm or more to 10,000 atomic ppm or less, more preferably from 50 atomic ppm or more to 7,000 atomic ppm or less, and most preferably from 100 atomic ppm or more to 5,000 atomic ppm or less, based on the total amount of constituent atoms.

The lower-part charge injection blocking layer 103 may further be incorporated with nitrogen and oxygen. This enables achievement of an improvement in adherence between the lower-part charge injection blocking layer 103 and the conductive substrate 101. In the case of negative-charging electrophotographic photosensitive members, the incorporation of nitrogen and oxygen in an optimum state makes it possible for them to have superior charge-blocking ability even without doping any element capable of controlling conductivity. Stated specifically, nitrogen atoms and oxygen atoms incorporated in the whole layer region of the lower-part charge injection blocking layer 103 may be in a content, as the sum of nitrogen and oxygen, of from 0.1 atomic % or more to 40 atomic % or less, and preferably from 1.2 atomic % or more to 20 atomic % or less, based on the total amount of constituent atoms.

The lower-part charge injection blocking layer 103 in the present invention may also be incorporated with hydrogen and/or halogen atoms. This affords the effect of compensating unbonded arms of silicon atoms present in the layer to improve film quality. The hydrogen and/or halogen atoms incorporated in the lower-part charge injection blocking layer 103 may preferably be in a content of from 1 atomic % or more to 50 atomic % or less, more preferably from 5 atomic % or more to 40 atomic % or less, and still more preferably from 10 atomic % or more to 30 atomic % or less, in total, based on the total amount of constituent atoms.

In the present invention, taking account of the desired electrophotographic performances to be obtained and also an economical effect, the lower-part charge injection blocking layer 103 may preferably be in a layer thickness of from 100 nm or more to. 5,000 nm or less, more preferably from 300 nm or more to 4,000 nm or less, and most preferably from 500 nm or more to 3,000 nm or less. Its formation in the layer thickness of from 100 nm or more to 5,000 nm or less makes the layer have a sufficient ability to block the injection of electric charges from the conductive substrate 101, so that a sufficient charging performance can be achieved and at the same time an improvement in electrophotographic performances can be expected, not causing any difficulties such as rise in residual potential.

To form the lower-part charge injection blocking layer 103, gas pressure inside a reactor, discharge power and substrate temperature must appropriately be set. The temperature (Ts) of the conductive substrate may appropriately be selected within an optimum range in accordance with layer designing. In usual cases, the temperature may preferably be set at from 150° C. or more to 350° C. or less, more preferably from 180° C. or more to 330° C. or less, and most preferably from 200° C. or more to 300° C. or less.

The pressure inside the reactor may also likewise appropriately be selected within an optimum range in accordance with layer designing. In usual cases, it may be set at from $1\times10^{-2}$ Pa or more to $1\times10^{3}$ Pa or less, and preferably from $5\times10^{-2}$ Pa or more to $5\times10^{2}$ Pa or less, and most preferably from $1\times10^{-1}$ Pa or more to $1\times10^{2}$ Pa or less.

Photoconductive Layer

The photoconductive layer 104 in the electrophotographic photosensitive member of the present invention, is a film containing an amorphous material composed chiefly of silicon atoms and the film may preferably be incorporated therein with hydrogen atoms and/or halogen atoms. This is because they compensate unbonded arms of silicon atoms and are effective in order to improve layer quality, in particular, to improve photoconductivity and charge retentivity. The hydrogen atoms or halogen atoms, or the hydrogen atoms and halogen atoms, may preferably be in a content of from 10 atomic % or more to 40 atomic % or less, and more preferably from 15 atomic % or more to 25 atomic % or less. To control the amount of hydrogen atoms and/or halogen atoms incorporated in the photoconductive layer 104, it may be done by controlling, e.g., the temperature of the conductive substrate 101, the amount(s) in which source gases used to incorporate the hydrogen atoms and/or halogen atoms are fed into the reactor, the discharge power, and so forth.

In the present invention, the photoconductive layer 104 may optionally be incorporated with an element capable of controlling conductivity. As the element to be incorporated, like the lower-part charge injection blocking layer 103, a periodic-table Group 13 element may be used. The element capable of controlling conductivity, incorporated in the photoconductive layer 104 may preferably be in a content of from $1\times10^{-2}$ atomic ppm or more to $1\times10^{4}$ atomic ppm or less, more preferably from $5\times10^{-2}$ atomic ppm or more to $5\times10^{3}$ atomic ppm or less, and most preferably from $1\times10^{-1}$ atomic ppm or more to $1\times10^{3}$ atomic ppm or less, based on the total amount of constituent atoms.

In the present invention, the layer thickness of the photoconductive layer 104 may appropriately be determined as desired, taking account of the desired electrophotographic performances to be obtained and also an economical effect, and the layer may preferably be in a thickness of from 10 $\mu$m or more to 50 $\mu$m or less, more preferably from 20 $\mu$m or more to 45 $\mu$m or less, and most preferably from 25 $\mu$m or more to 40 $\mu$m or less.

To form the photoconductive layer 104, gas pressure inside a reactor, discharge power and substrate temperature must appropriately be set. The temperature (Ts) of the conductive substrate may appropriately be selected within an optimum range in accordance with layer designing. In usual cases, the temperature may preferably be set at from 150° C. or more to 350° C. or less, more preferably from 180° C. or more to 330° C. or less, and most preferably from 200° C. or more to 300° C. or less.

The pressure inside the reactor may also likewise appropriately be selected within an optimum range in accordance with layer designing. In usual cases, it may be set at from $1\times10^{-2}$ Pa or more to $1\times10^{3}$ Pa or less, and preferably from $5\times10^{-2}$ Pa or more to $5\times10^{2}$ Pa or less, and most preferably from $1\times10^{-1}$ Pa or more to $1\times10^{2}$ Pa or less.

Layer Region on Photoconductive Layer

In the present invention, to form the distribution in which the content of the periodic-table Group 13 element based on the total amount of constituent atoms in the layer region deposited on the photoconductive layer has at least any two of maximum value(s) and maximum region(s) in the thickness direction of the amorphous-silicon layer region, the layer region deposited on the photoconductive layer 104 may preferably have construction consisting of two layers of the first upper-part charge injection blocking layer 105 and the second upper-part charge injection blocking layer 107 which are formed interposing the intermediate layer 106 and the surface protective layer 108 is formed thereon.

Upper-part Charge Injection Blocking Layers:

The upper-part charge injection blocking layers 105 and 107 have the function to prevent electric charges from being injected from the surface side to the photoconductive-layer side when the photosensitive member is subjected to charging in a certain polarity on its free surface, and exhibits no such function when subjected to charging in a reverse polarity. In order to provide such function, it is necessary for the upper-part charge injection blocking layers 105 and 107 to be properly incorporated with atoms capable of controlling conductivity.

As the atoms used for such purpose, a periodic-table Group 13 element may be used in the present invention. The using of such an atom provides a negative chargeable electrophotographic photosensitive member. The periodic-table Group 13 element may specifically include boron (B), aluminum (Al), gallium (Ga), indium (In) and thallium (Tl). In particular, boron is preferred.

The content of the atoms capable of controlling conductivity which are to be incorporated in the first upper-part charge injection blocking layer 105 or second upper-part charge injection blocking layer 107 depends on the composition of the first or second upper-part charge injection blocking layers and the manner of production, and can not sweepingly be defined. Such atoms may preferably be in a content of from 50 atomic ppm or more to 3,000 atomic ppm or less, and more preferably from 100 atomic ppm or more to 1500 atomic ppm or less, based on the total amount of the constituent atoms, as the maximum value.

The atoms capable of controlling the conductivity which are contained in the upper-part charge injection blocking layers 105 and 107 may evenly uniformly be distributed in the upper-part charge injection blocking layers 105 and 107, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

The upper-part blocking layers 105 and 107 may be formed using any materials so long as they are amorphous-silicon materials, and may preferably be constituted of the same material as the intermediate layer 106 and/or the surface protective layer 108. More specifically, preferably usable are "a-SiC:H,X" (amorphous silicon containing a hydrogen atom (H) and/or a halogen atom (X) and further containing a carbon atom), "a-SiO:H,X"(amorphous silicon containing a hydrogen atom (H) and/or a halogen atom (X) and further containing an oxygen atom), "a-SiN:H,X"(amorphous silicon containing a hydrogen atom (H) and/or a halogen atom (X) and further containing a nitrogen atom), and "a-SiCON:H,X"(amorphous silicon containing a hydrogen atom (H) and/or a halogen atom (X) and further containing at least one of a carbon atom, an oxygen atom and a nitrogen atom). The carbon atoms or nitrogen atoms or oxygen atoms contained in the upper-part charge injection blocking layers 105 and 107 may evenly uniformly be distributed in those layers, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

The content of the carbon atoms and/or nitrogen atoms and/or oxygen atoms to be incorporated in each layer of the upper-part charge injection blocking layers 105 and 107 may appropriately be so determined that the object of the present invention can effectively be achieved. It may preferably be in the range of from 10 atomic % or more to 70 atomic % or less, more preferably from 15 atomic % or more to 65 atomic % or less, and still more preferably from 20 atomic % or more to 60 atomic % less, based on the total sum of silicon atoms, as the amount of one kind when any one kind of these is incorporated, and as the amount of total sum when two or more kinds of these are incorporated.

In the present invention, the upper-part charge injection blocking layers 105 and 107 may preferably be incorporated with hydrogen atoms and/or halogen atoms. This is because they are incorporated in order to compensate unbonded arms of silicon atoms to improve layer quality, in particular, to improve photoconductivity and charge retentivity. The hydrogen atoms may usually be in a content of from 30 atomic % or more to 70 atomic % or less, preferably from 35 atomic % or more to 65 atomic % or less, and most preferably from 40 atomic % or more to 60 atomic % or less, based on the total amount of constituent atoms. The halogen atoms may usually be in a content of from 0.01 atomic % or more to 15 atomic % or less, preferably from 0.1 atomic % to 10 atomic % or less, and more preferably from 0.5 atomic % to 5 atomic % or less.

In the present invention, taking account of the desired electrophotographic performances to be obtained and also an economical effect, the upper-part charge injection blocking layers 105 and 107 may each preferably be in a layer thickness of from 10 nm or more to 1,000 nm or less, more preferably from 30 nm or more to 800 nm or less, and most preferably from 50 nm or more to 500 nm or less. Its formation in the layer thickness of 10 nm or more makes the layers have a sufficient ability to block the injection of electric charges from the surface side, so that a sufficient charging performance can be achieved and good electrophotographic performances can be achieved. Also, in the layer thickness of 1,000 nm or less, an improvement in electrophotographic performances can be expected, and good sensitivity characteristics can be achieved.

The upper-part charge injection blocking layers 105 and 107 may preferably have composition made to change continuously from the photoconductive layer 104 toward the surface protective layer 108. This is effective in improving adherence or preventing interference.

The first upper-part charge injection blocking layer 105 and the second upper-part charge injection blocking layer 107 may also be incorporated with carbon atoms. Since, however, the present invention is so constructed that at least any two of maximum value(s) and maximum region(s) of the carbon atom content based on the total amount of constituent atoms are provided in the layer region deposited on the photoconductive layer 104, the carbon atoms may preferably be in a content of 30 atomic % or less based on the total amount of constituent atoms.

To form upper-part charge injection blocking layers 105 and 107 having characteristics that can achieve the object of the present invention, it is necessary to appropriately set the mixing ratio of silicon-feeding gas to carbon- and/or nitrogen- and/or oxygen-feeding gas(es), the gas pressure inside a reactor, the discharge power and the substrate temperature.

Where the upper-part charge injection blocking layers 105 and 107 have maximum values in the thickness direction of the periodic-table Group 13 element content, in order to improve chargeability characteristics (charging performance) it is preferable that a maximum value positioned on the outermost surface protective layer side is largest.

The temperature of the substrate may also appropriately be selected within an optimum range in accordance with layer designing. In usual cases, the temperature may preferably be set at from 150° C. or more to 350° C. or less, more preferably from 180° C. or more to 330° C. or less, and most preferably from 200° C. or more to 300° C. or less.

The pressure inside the reactor may also likewise appropriately be selected within an optimum range in accordance with layer designing. In usual cases, it may be set at from $1\times10^{-2}$ Pa or more to $1\times10^{3}$ Pa or less, and preferably, from $5\times10^{-2}$ Pa or more to $5\times10^{2}$ Pa or less, and most preferably from $1\times10^{-1}$ Pa or more to $1\times10^{2}$ Pa or less.

In the present invention, desirable numerical ranges of the dilute gas mixing ratio, gas pressure, discharge power and substrate temperature for forming the upper-part charge injection blocking layers 105 and 107 may include the ranges given above, but these film formation factors are by no means independently separately determined in usual cases. Optimum values of film formation factors should be determined on the basis of mutual and systematic relationship so that photosensitive members having the desired characteristics can be formed.

Intermediate Layer

The intermediate layer 106 according to the present invention is provided between the first upper-part charge injection blocking layer 105 and the second upper-part charge injection blocking layer 107 in order to form the distribution in which the content of the periodic-table Group 13 element based on the total amount of constituent atoms in the amorphous-silicon layer region deposited on the photoconductive layer has at least any two of maximum value(s) and maximum region(s) in the thickness direction of the amorphous-silicon layer region.

The intermediate layer 106 may preferably be composed chiefly of silicon atoms and optionally containing at least one of carbon, nitrogen and oxygen relatively in a large quantity. Preferably, the maximum values of the content of carbon atoms may preferably be so made as to be from 40 atomic % or more to 95 atomic % or less based on the total amount of all atoms constituting at least one layer that forms the intermediate layer 106. The carbon atoms or nitrogen atoms or oxygen atoms contained in the intermediate layer 106 may evenly uniformly be distributed in the layer, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

With regard to the carbon atoms, they may preferably be incorporated in the intermediate layer 106 in a content larger than those in the first upper-part charge injection blocking layer 105 or second upper-part charge injection blocking layer 107.

The intermediate layer 106 may as well further be incorporated with a periodic-table Group 13 element content, which may preferably be in a content of from 50 atomic ppm or less based on the total amount of constituent atoms so that the effect of the present invention can be obtained.

The layer thickness of this intermediate layer 106 may preferably be so controlled that the distance between any two of maximum value(s) and maximum region(s) adjacent to each other of the periodic-table Group 13 element content based on the total amount of constituent atoms may come to be from 100 nm or more to 1,000 nm or less, more preferably from 200 nm or more to 800 nm or less, and still more preferably from 300 nm or more to 600 nm or less.

Surface Protective Layer:

The surface protective layer 108 has a free surface, and is effective in improvement chiefly in moisture resistance, performance on continuous repeated use, electrical breakdown strength, service environmental properties and running performance.

Where an a-Si material is used as a material for the surface protective layer 108, preferred is a compound with silicon atoms which contains at least one element selected from carbon, nitrogen and oxygen. In particular, one composed chiefly of a-SiC is preferred.

Where the surface protective layer 108 contains at least one of carbon, nitrogen and oxygen, the maximum value(s) or maximum region value(s) of the content of the total amount of any of these atoms may preferably be in the range from 40 atomic % to 95 atomic % based on all the atoms constituting a network. Controlling the same within this range makes the surface protective layer 108 have good abrasion resistance and also can provide good sensitivity.

In addition, in the surface protective layer 108 deposited in a higher position than the photoconductive layer 104, the maximum region value of the content of carbon atoms based on the total amount of constituent atoms may be made largest. This makes it possible to obtain the effect of restraining melt adhesion.

The carbon atoms contained in the intermediate layer 106 may evenly uniformly be distributed in the layer, or may be contained in such a state that they are distributed non-uniformly in the layer thickness direction. In any case, however, in the in-plane direction parallel to the surface of the conductive substrate, it is necessary for such atoms to be evenly contained in a uniform distribution so that the properties in the in-plane direction can also be made uniform.

The surface protective layer 108 may be incorporated with hydrogen atoms or halogen atoms. Such atoms compensate unbonded arms of constituent atoms such as silicon atoms to improve layer quality, in particular, to improve photoconductivity and charge retentivity. From such a viewpoint, the hydrogen atoms may preferably be in a content of from 30 atomic % or more to 70 atomic % or less, preferably from 35 atomic % or more to 65 atomic % or less, and still more preferably from 40 atomic % or more to 60 atomic % or less, based on the total amount of constituent atoms. The halogen atoms, e.g., fluorine atoms, may usually be in a content of from 0.01 atomic % or more to 15 atomic % or less, preferably from 0.1 atomic % to 10 atomic % or less, and most preferably from 0.6 atomic % to 4 atomic % or less.

As to the layer thickness of the surface protective layer 108, the layer may usually have a thickness of from 10 nm or more to 3,000 nm or less, preferably from 50 nm or more to 2,000 nm or less, and most preferably from 100 nm or more to 1,000 nm or less. As long as its layer thickness is 10 nm or more, the surface protective layer 108 can not be lost because of wear or the like while the photosensitive member is used. As long as it is 3,000 nm or less, any lowering of electrophotographic performances, e.g., an increase in residual potential can not be seen.

To form a surface protective layer 108 having characteristics that can achieve the object of the present invention, substrate temperature and gas pressure inside a reactor must appropriately be set as desired. The substrate temperature (Ts) may appropriately be selected within an optimum range in accordance with layer designing. In usual cases, the temperature may preferably be set at from 150° C. or more to 350° C. or less, more preferably from 180° C. or more to 330° C. or less, and most preferably from 200° C. or more to 300° C. or less.

The pressure inside the reactor may also likewise appropriately be selected within an optimum range in accordance with layer designing. In usual cases, it may be set at from $1\times10^{-2}$ Pa or more to $1\times10^{3}$ Pa or less, and preferably from $5\times10^{-2}$ Pa or more to $5\times10^{2}$ Pa or less, and most preferably from $1\times10^{-1}$ Pa or more to $1\times10^{2}$ Pa or less.

In the present invention, desirable numerical ranges of the substrate temperature and gas pressure, discharge power for forming the surface protective layer 108 may include the ranges given above, but these conditions are by no means independently separately determined in usual cases. Optimum values of conditions should be determined on the basis of mutual and systematic relationship so that photosensitive members having the desired characteristics can be formed.

Deposited-Film Formation Apparatus

An apparatus, and a film formation process, for producing the electrophotographic photosensitive member is described below.

Figure 3:
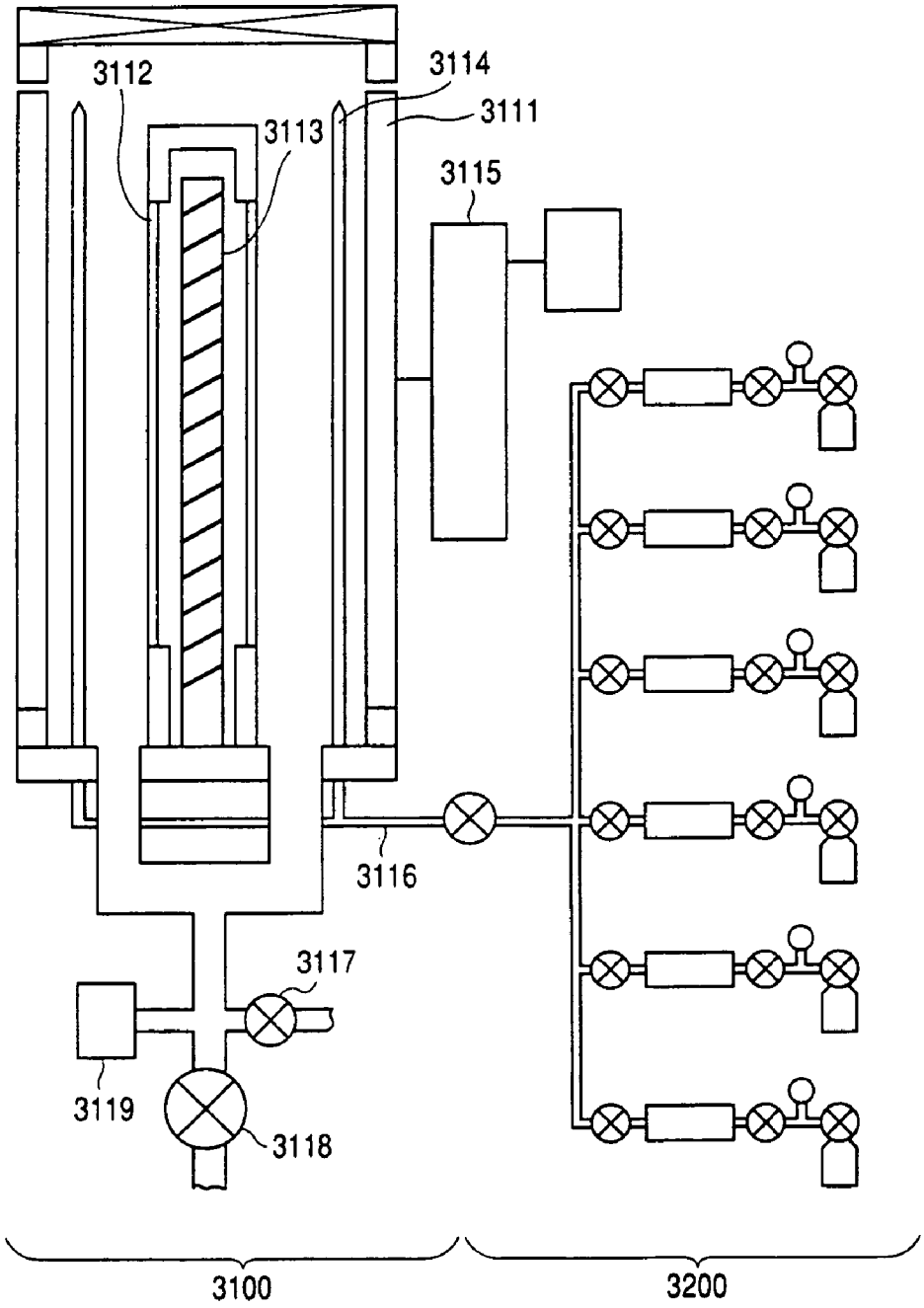
FIG. 3 is a diagrammatic sectional view to illustrate a deposited-film formation apparatus.

FIG. 3 is a diagrammatic view of an embodiment of a deposited-film formation apparatus applicable in the present invention.

The apparatus shown in FIG. 3 is an apparatus for forming deposited films by plasma-assisted CVD making use of an RF band frequency (RF-PCVD).

The deposited-film formation apparatus shown in FIG. 3 is an apparatus in which a conductive cylindrical substrate 3112 has been set in a cylindrical reactor.

One end of an evacuation pipe is formed at the bottom surface of the cylindrical reactor, and the other end thereof is connected to an evacuation system (not shown).

Source gases are fed into the reactor through source gas feed pipes 3114. Also, high-frequency power is supplied to the inside of the reactor by a high-frequency electrode 3111 via a matching box 3115.

Where such an apparatus shown in FIG. 3 is used, deposited films may be formed according to the following procedure on the whole.

First, the cylindrical substrate 3112 is placed in the reactor, and the inside of the reactor is evacuated by means of an evacuation device (not shown) through the evacuation pipe. Subsequently, the cylindrical substrate 3112 is heated and controlled to a stated temperature by means of a heater 3113.

At the time the cylindrical substrates 3112 has reached the stated temperature, source cases are fed into the reactor via the source gas feed pines 3114. After making sure that the flow rates of the source gases have come to be preset flow rates and also the internal pressure of the reactor has become stable, a stated high-frequency power is supplied from a high-frequency power source with an oscillation frequency of, e.g., 13.56 MHz to the high-frequency electrode 3111 via the matching box 3115. This causes glow discharge to take place in the reactor, and the source gases fed thereinto are excited to undergo dissociation. Thus, a deposited film is formed on the cylindrical substrate 3112.

EXAMPLES

The present invention is described below in greater detail by giving Examples and Comparative Example.

Example A-1

Using the deposited-film formation apparatus of an RF-PCVD system as shown in FIG. 3, a lower-part charge injection blocking layer, a photoconductive layer, a first upper-part charge injection blocking layer (in FIG. 2, BL-1), an intermediate layer (IML), a second upper-part charge injection blocking layer (BL-2) and a surface protective layer (SL) were formed on a mirror-finished cylindrical aluminum substrate of 80 mm in diameter under conditions shown in Table A-1, to produce a negative-charging electrophotographic photosensitive member.

As source gas for the periodic-table Group 13 element, diborane gas was used.

The content of the periodic-table Group 13 element (B: boron) in the first upper-part charge injection blocking layer and second upper-part charge injection blocking layer of this Example was examined by secondary ion mass spectroscopy (SIMS) to find that its maximum values were 200 atomic ppm and 200 atomic ppm, respectively, based on the total amount of constituent atoms. Distribution having two maximum values as shown by a curve in FIG. 2 was obtained.

The intermediate layer little contained the periodic-table Group 13 element. The periodic-table Group 13 element content distributed in the layer region deposited on the photoconductive layer was as shown in FIG. 2, where the maximum value on the photoconductive layer side was 200 atomic ppm, the maximum value on the surface protective layer side was also 200 atomic ppm and the minimum value between the two maximum values was 0.2 atomic ppm, based on the total amount of constituent atoms. Also, the distance between the two maximum values of the periodic-table Group 13 element content distributed in the layer region deposited on the photoconductive layer was 350 nm.

TABLE A-1

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 200 | 100 | 12 | 100 | 12 |
| $H_2$ [ml/min(normal)] | 500 | 800 | 0 | 0 | 0 | 0 |
| Maximum value of periodic-table Group 13 element (B) content based on total amount of constituent atoms: (atomic ppm) | 0 | 0 | 200 | 0.2 | 200 | 0 |
| NO [ml/min(normal)] | 8 | 0 | 0 | 0 | 0 | 0 |
| $CH_4$ [ml/min(normal)] | 0 | 0 | 120 | 630 | 120 | 630 |

TABLE A-1-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 600 | 330 | 150 | 330 | 150 |
| Layer thickness: (μm) | 3 | 32 | 0.2 | 0.15 | 0.2 | 0.5 |

Comparative Example A-1

In this Comparative Example, the procedure of Example A-1 was repeated except that only the lower-part charge injection blocking layer, photoconductive layer, first upper-part charge injection blocking layer and surface protective layer were formed on the mirror-finished cylindrical aluminum substrate under the conditions shown in Table A-1, to produce a negative-charging electrophotographic photosensitive member.

In this Comparative Example, the intermediate layer and the second upper-part charge injection blocking layer were not deposited. Thus, the content of the periodic-table Group 13 element contained in the layer region deposited on the photoconductive layer has distribution having one maximum value in the thickness direction of the amorphous-silicon layer.

The first upper-part charge injection blocking layer in this Comparative Example was in a layer thickness of 200 nm. The maximum value of the periodic-table Group 13 element (B: boron) content in that layer was, which was examined by secondary ion mass spectroscopy (SIMS), found to be 200 atomic ppm based on the total amount of constituent atoms.

Comparative Example A-2

In this Comparative Example, the procedure of Example A-1 was repeated except that only the lower-part charge injection blocking layer, photoconductive layer, first upper-part charge injection blocking layer and surface protective layer were formed on the mirror-finished cylindrical aluminum substrate under the conditions shown in Table A-1, to produce a negative-charging electrophotographic photosensitive member.

In this Comparative Example, like Comparative Example A-1, the intermediate layer and the second upper-part charge injection blocking layer were not deposited. Thus, the content of the periodic-table Group 13 element contained in the layer region deposited on the photoconductive layer has distribution having one maximum value in the thickness direction of the amorphous-silicon layer by feeding diborane gas.

The first upper-part charge injection blocking layer in this Comparative Example A-2 was in a layer thickness of 550 nm, while it was 200 nm in Comparative Example A-1. The maximum value of the periodic-table Group 13 element (B: boron) content in the first upper-part charge injection blocking layer was, which was examined by secondary ion mass spectroscopy (SIMS), found to be 200 atomic ppm based on the total amount of constituent atoms.

The negative-charging electrophotographic photosensitive members produced in Example A-1, Comparative Example A-1 and Comparative Example A-2 were each set in an electrophotographic apparatus (a remodeled machine of iR6000, trade name, manufactured by CANON INC.; remodeled for evaluation in a negative-charging system) to evaluate performances.

Evaluation was made on four items "pressure mar test", "charging performance", "sensitivity" and "photomemory" by the following specific evaluation methods.

Pressure Mar Test:

Using a surface property tester manufactured by HEIDON CO., a diamond needle of 0.8 mm in tip diameter and with a curvature (round tip) is brought into touch with the electrophotographic photosensitive member surface under application of a constant load thereto.

In this state, the diamond needle is moved in the lengthwise direction of the electrophotographic photosensitive member at a speed of 50 mm/min. This operation is repeated changing the load and changing measurement positions.

Next, after observation with a metal microscope to make sure that any scratches have not been made at the electrophotographic photosensitive member surface, halftone images with a reflection density of 0.5 are formed using the electrophotographic apparatus. The load at which the pressure mar marks begin to appear on the images formed is regarded as pressure marred load. Evaluation is made by ranking the results by relative comparison regarding the pressure marred load (unit: g) in Comparative Example A-1 as 100%. Thus, it means that, the larger the numerical values are, the more the pressure mars do not easily form and the better.

A: 115% or more. Very good.

B: From 105% or more to less than 115%. Good.

C: Equal to Comparative Example A-1. No problem in practical use.

Charging Performance:

The electrophotographic photosensitive member is set in the electrophotographic apparatus, and a high voltage of −6 kV is applied to its charging assembly to perform corona charging, where the dark-area surface potential of the electrophotographic photosensitive member is measured with a surface potentiometer installed at the position of the developing assembly.

The results obtained are ranked by relative evaluation regarding as 100% the value (unit: V) obtained in Comparative Example A-1.

A: 115% or more. Very good.

B: From 105% or more to less than 115%. Good.

C: Equal to Comparative Example A-1. No problem in practical use.

Sensitivity:

The current value of the charging assembly is so adjusted that the surface potential comes to be −450 V (dark-area potential) under the above conditions. Thereafter, the electrophotographic photosensitive member is subjected to image exposure (semiconductor laser of 655 nm in wavelength), where the amount of light of a light source of the image exposure is so adjusted that the surface potential comes to be −50 V (light-area potential), and the amount of exposure light that has been necessary therefor is regarded as sensitivity. Thus, the smaller the values of sensitivity are, the better.

The results obtained are ranked by relative evaluation regarding as 100% the value (unit: lux.sec) obtained in Comparative Example A-1.

A: Less than 85%. Very good.

B: From 85% or more to less than 95%. Good.

C: Equal to Comparative Example A-1. No problem in practical use.

Photomemory:

Photomemory is evaluated by photomemory potential. Like the above evaluation of sensitivity, setting the dark-area potential at −450 V, the electrophotographic photosensitive member is first subjected to image exposure to thereby set the light-area potential at −50 V, and thereafter again charged, where dark-area potential is measured. The potential difference between these is regarded as photomemory potential. Thus, the smaller the photomemory potential is, the better.

The results obtained are ranked by relative evaluation regarding as 100% the value (unit: V) obtained in Comparative Example A-1.

A: Less than 85%. Very good.

B: From 85% or more to less than 95%. Good.

C: Equal to Comparative Example A-1. No problem in practical use.

The results of evaluation are shown in Table A-2.

TABLE A-2

| | Example A-1 | Comparative Example A-1 | Comparative Example A-2 |
|---|---|---|---|
| Pressure mar test: | A | C | A |
| Charging performance: | A | C | B |
| Sensitivity: | B | C | C |
| Photomemory: | B | C | C |

As can be seen from the results shown in Table A-2, it has been ascertained that in Example A-1, which is of the present invention, the charging performance is improved and also the pressure mars are better kept from forming, compared with that in Comparative Example A-1, to obtain good image characteristics. Also, in Comparative Example A-2, the formation of the first upper-part charge injection blocking layer in a larger thickness has better kept the pressure mars from forming, but low performances are seen in respect of the sensitivity and the photomemory.

Example A-2

In this Example, like Example A-1, using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were formed on a mirror-finished cylindrical aluminum substrate of 80 mm in diameter, but under conditions shown in Table A-3, to produce a negative-charging electrophotographic photosensitive member.

As source gas for the periodic-table Group 13 element, diborane gas was used.

In this Example A-2, the deposition time for forming the intermediate layer was changed to change the layer thickness of the intermediate layer to produce negative-charging electrophotographic photosensitive members in which the distance between two maximum values of the periodic-table Group 13 element content distributed in the layer region deposited on the photoconductive layer was made to be from 80 nm or more to 1,200 nm or less.

The content of the periodic-table Group 13 element (B: boron) in the first upper-part charge injection blocking layer and second upper-part charge injection blocking layer of this Example was examined by secondary ion mass spectroscopy (SIMS) to find that its maximum values were 200 atomic ppm and 200 atomic ppm, respectively, based on the total amount of constituent atoms. Distribution having two maximum values as shown by a curve in FIG. 2 was obtained.

The intermediate layer little contained the periodic-table Group 13 element. The periodic-table Group 13 element content distributed in the layer region deposited on the photoconductive layer was as shown in FIG. 2, where the maximum value on the photoconductive layer side was 200 atomic ppm, the maximum value on the surface protective layer side was 200 atomic ppm and the minimum value between the two maximum values was 0.2 atomic ppm, based on the total amount of constituent atoms.

TABLE A-3

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 400 | 90 | 10 | 90 | 12 |
| $H_2$ [ml/min(normal)] | 500 | 1,200 | 0 | 0 | 0 | 0 |
| Maximum value of periodic-table Group 13 element (B) content based on total amount of constituent atoms: (atomic ppm) | 0 | 0 | 200 | 0.2 | 200 | 0 |

TABLE A-3-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| NO [ml/min(normal)] | 8 | 0 | 0 | 0 | 0 | 0 |
| $CH_4$ [ml/min(normal)] | 0 | 0 | 100 | 580 | 100 | 630 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 700 | 330 | 130 | 300 | 150 |
| Layer thickness: (μm) | 3 | 20 | 0.05 | 0.03 to 1.15 | 0.05 | 0.5 |

The negative-charging electrophotographic photosensitive members produced in Example A-2 were each set in an electrophotographic apparatus (a remodeled machine of iR6000, trade name, manufactured by CANON INC.; remodeled for evaluation in a negative-charging system) to evaluate performances in the same manner as in Example A-1.

Evaluation was made on two items "pressure mar test" and "charging performance". The results of evaluation are shown in Table A-4. In Table A-4, relative comparison is made regarding as 100 the values obtained in Comparative Example A-1.

TABLE A-4

| | Distance between maximum values: (nm) | | | | | | |
|---|---|---|---|---|---|---|---|
| | 80 | 90 | 100 | 500 | 1,000 | 1,100 | 1,200 |
| Pressure mar test: | B | B | A | A | A | A | A |
| Charging performance: | A | A | A | A | A | B | B |

As can be seen from the results shown in Table A-4, especially good results are obtained in regard to the improvements of pressure mars and charging performance when the distance between maximum values of the periodic-table Group 13 element content distributed in the layer region deposited on the photoconductive layer is in the range of from 100 nm or more to 1,000 nm or less.

Example A-3

In this Example, like Example A-1, using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were formed on a mirror-finished cylindrical aluminum substrate of 80 mm in diameter, but under conditions shown in Table A-5, to produce a negative-charging electrophotographic photosensitive member.

As source gas for the periodic-table Group 13 element, diborane gas was used.

In this Example A-3, the flow rate of the boron source diborane $B_2H_6$ was changed to change the periodic-table Group 13 element content based on the total amount of constituent atoms contained in the first upper-part charge injection blocking layer, to produce negative-charging electrophotographic photosensitive members in which the maximum value on the photoconductive-layer side was from 80 atomic ppm or more to 400 atomic ppm or less.

The content of the periodic-table Group 13 element based on the total amount of constituent atoms, contained in the second upper-part charge injection blocking layer, was kept constant to have a maximum value of 400 atomic ppm.

The intermediate layer little contained the periodic-table Group 13 element. The periodic-table Group 13 element content distributed in the first upper-part charge infection blocking layer and second upper-part charge injection blocking layer deposited on the photoconductive layer was as shown in FIG. 2, and the minimum value between the two maximum values was 0.2 atomic ppm based on the total amount of constituent atoms.

In addition, the distance between the two maximum values of the periodic-table Group 13 element content distributed in the layer region deposited on the photoconductive layer was 400 nm in the thickness direction of the amorphous-silicon layer.

TABLE A-5

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 100 | 90 | 12 | 90 | 12 |
| $H_2$ [ml/min(normal)] | 500 | 400 | 0 | 0 | 0 | 0 |
| Maximum value of periodic-table Group 13 element (B) content based on total amount of constituent atoms: (atomic ppm) | 0 | 1 | 80 to 400 | 0.2 | 400 | 0 |

TABLE A-5-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| NO [ml/min(normal)] | 8 | 0 | 0 | 0 | 0 | 0 |
| $CH_4$ [ml/min(normal)] | 0 | 0 | 70 | 630 | 70 | 630 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 400 | 250 | 150 | 250 | 150 |
| Layer thickness: (μm) | 3 | 32 | 0.2 | 0.2 | 0.2 | 0.5 |

The negative-charging electrophotographic photosensitive members produced in Example A-3 were each set in an electrophotographic apparatus (a remodeled machine of iR6000, trade name, manufactured by CANON INC.; remodeled for evaluation in a negative-charging system) to evaluate performances in the same manner as in Example A-1.

Evaluation was made on two items "pressure mar test" and "charging performance". The results of evaluation are shown in Table A-6. In Table A-6, relative comparison is made regarding as 100 the values obtained in Comparative Example A-1.

TABLE A-6

| | Maximum value on photoconductive layer side: (atomic ppm) | | | | |
|---|---|---|---|---|---|
| | 80 | 90 | 100 | 200 | 400 |
| Pressure mar test: | A | A | A | A | A |
| Charging performance: | B | B | A | A | A |

As can be seen from the results shown in Table A-6, in Example A-3, the results on both the pressure mar test and the charging performance are good when the photoconductive-layer side maximum value of the periodic-table Group 13 element content distributed in the layer region deposited on the photoconductive layer is 100 atomic ppm or more.

Example A-4

In this Example, like Example A-1, using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were formed on a mirror-finished cylindrical aluminum substrate of 80 mm in diameter, but under conditions shown in Table A-7, to produce a negative-charging electrophotographic photosensitive member.

As source gas for the periodic-table Group 13 element, diborane gas was used.

In this Example A-4, the flow rate of the boron source diborane $B_2H_6$ was changed to change the periodic-table Group 13 element content based on the total amount of constituent atoms contained in the intermediate layer, to produce negative-charging electrophotographic photosensitive members in which the minimum value between two maximum values as shown in FIG. 2 was from 0.2 atomic ppm or more to 70 atomic ppm or less.

The content of the periodic-table Group 13 element based on the total amount of constituent atoms, contained in the first upper-part charge injection blocking layer, and that in the second upper-part charge injection blocking layer, were each kept constant to have a maximum value of 300 atomic ppm.

In addition, the distance between the two maximum values of the periodic-table Group 13 element content distributed in the layer region deposited on the photoconductive layer was 350 nm in the thickness direction of the amorphous-silicon layer.

TABLE A-7

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 150 | 100 | 60 | 100 | 12 |
| $H_2$ [ml/min(normal)] | 500 | 1,000 | 0 | 0 | 0 | 0 |
| Maximum value of periodic-table Group 13 element (B) content based on total amount of constituent atoms: (atomic ppm) | 0 | 0.5 | 300 | 0.2 to 70 | 300 | 0 |

TABLE A-7-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| NO [ml/min(normal)] | 8 | 0 | 0 | 0 | 0 | 0 |
| $CH_4$ [ml/min(normal)] | 0 | 0 | 100 | 200 | 100 | 630 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 500 | 300 | 200 | 300 | 150 |
| Layer thickness: (μm) | 3 | 32 | 0.2 | 0.15 | 0.2 | 0.5 |

The negative-charging electrophotographic photosensitive members produced in Example A-4 were each set in an electrophotographic apparatus (a remodeled machine of iR6000, trade name, manufactured by CANON INC.; remodeled for evaluation in a negative-charging system) to evaluate performances in the same manner as in Example A-1.

Evaluation was made on four items "pressure mar test", "charging performance", "sensitivity" and "photomemory". The results of evaluation are shown in Table A-8. In Table A-8, relative comparison is made regarding as 100 the values obtained in Comparative Example A-1.

TABLE A-8

| | Minimum value: (atomic ppm) | | | | |
|---|---|---|---|---|---|
| | 0.2 | 25 | 50 | 60 | 70 |
| Pressure mar test: | A | A | A | A | A |
| Charging performance: | A | A | A | A | A |
| Sensitivity: | B | B | B | C | C |
| Photomemory: | B | B | B | C | C |

As can be seen from the results shown in Table A-8, in Example A-4, the results on the pressure mar test and the charging performance are good and also good results are obtained in regard to the sensitivity and the photomemory when the minimum value between two maximum values of the periodic-table Group 13 element content distributed,in the layer region deposited on the photoconductive layer, is 50 atomic ppm or less.

Example A-5

In this Example, like Example A-1, using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were formed on a mirror-finished cylindrical aluminum substrate of 80 mm in diameter, but under conditions shown in Table A-9, to produce a negative-charging electrophotographic photosensitive member.

As source gas for the periodic-table Group 13 element, diborane gas was used.

In this Example A-5, the flow rate of the boron source diborane $B_2H_6$ was changed to obtain two electrophotographic photosensitive members in one of which, in the layer region deposited on the photoconductive layer, the maximum values of the periodic-table Group 13 element content based on the total amount of constituent atoms are larger in the maximum value on the surface protective layer side than the maximum value on the photoconductive layer side and in the other of which the maximum values are smaller in the maximum value on the surface protective layer side. Here, the content of the periodic-table Group 13 element (B: boron) was examined by secondary ion mass spectroscopy (SIMS) to find that the maximum value on the photoconductive layer side was 200 atomic ppm, while the maximum value on the surface protective layer side was 100 atomic ppm and 400 atomic ppm.

The intermediate layer little contained the periodic-table Group 13 element, and the minimum value between the two maximum values was 0.2 atomic ppm.

The distance between the two maximum values of the periodic-table Group 13 element content distributed in the layer region deposited on the photoconductive layer was 350 nm in the thickness direction of the amorphous-silicon layer.

TABLE A-9

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 150 | 100 | 60 | 100 | 12 |
| $H_2$ [ml/min(normal)] | 500 | 1,000 | 0 | 0 | 0 | 0 |

TABLE A-9-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| Maximum value of periodic-table Group 13 element (B) content based on total amount of constituent atoms: (atomic ppm) | 0 | 0.5 | 200 | 0.2 | 100, 400 | 0 |
| NO [ml/min(normal)] | 8 | 0 | 0 | 0 | 0 | 0 |
| $CH_4$ [ml/min(normal)] | 0 | 0 | 100 | 200 | 100 | 630 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 500 | 300 | 200 | 300 | 150 |
| Layer thickness: (μm) | 3 | 32 | 0.2 | 0.15 | 0.2 | 0.5 |

The negative-charging electrophotographic photosensitive members produced in Example P-5 were each set in an electrophotographic apparatus (a remodeled machine of iR600, trade name, manufactured by CANON INC.; remodeled for evaluation in a negative-charging system) to evaluate performances in the same manner as in Example A-1.

Evaluation was made on two items "pressure mar test" and "charging performance".

As the result, in both the two electrophotographic photosensitive members, improvements in performances were seen in respect of the pressure mar test and the charging performance, and a more improvement in performance was seen in respect of the charging performance when the the maximum value on the surface protective layer side was set larger than the maximum value on the photoconductive layer side.

Example B-1

Using the deposited-film formation apparatus of an RF-PCVD system as shown in FIG. 3, a lower-part charge injection blocking layer, a photoconductive layer, a first upper-part charge injection blocking layer (in FIGS. 4B, 5B, etc., TBL-1), an intermediate layer (BF), a second upper-part charge injection blocking layer (TBL-2) and a surface protective layer (SL) were deposited on a mirror-finished cylindrical aluminum substrate of 80 mm in diameter under conditions shown in Table B-1, to produce a negative-charging electrophotographic photosensitive member.

As source gas for the periodic-table Group 13 element, diborane gas was used. As source gas for carbon atoms, methane gas was used.

The electrophotographic photosensitive member produced was analyzed by SIMS to reveal the following.

Figure 4B:
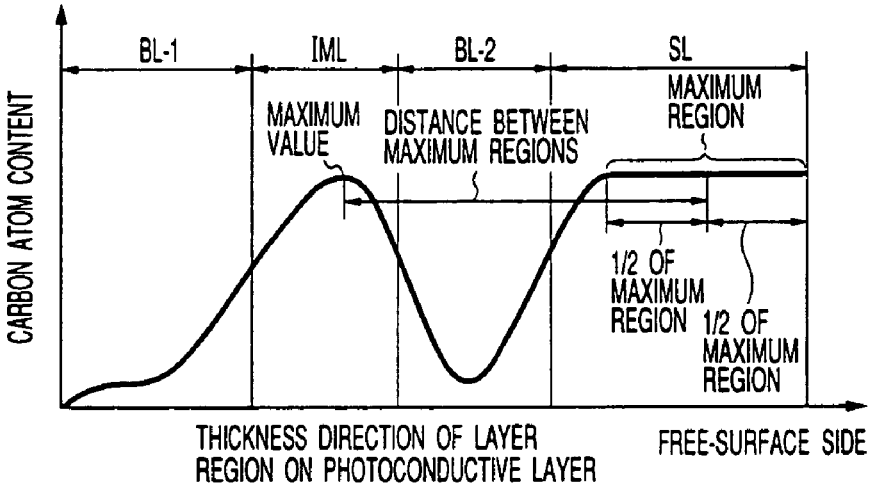
Figure 6A:
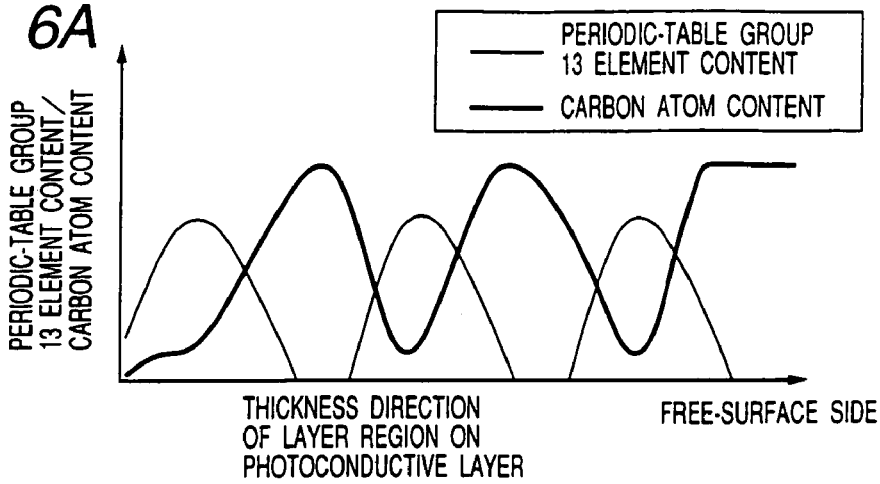
FIGS. 6A, 6B and 6C show distribution curves of the carbon atom content and periodic-table Group 13 element content in the thickness direction of an amorphous-silicon layer region of an a-Si photosensitive member of the present invention.
Figure 6B:
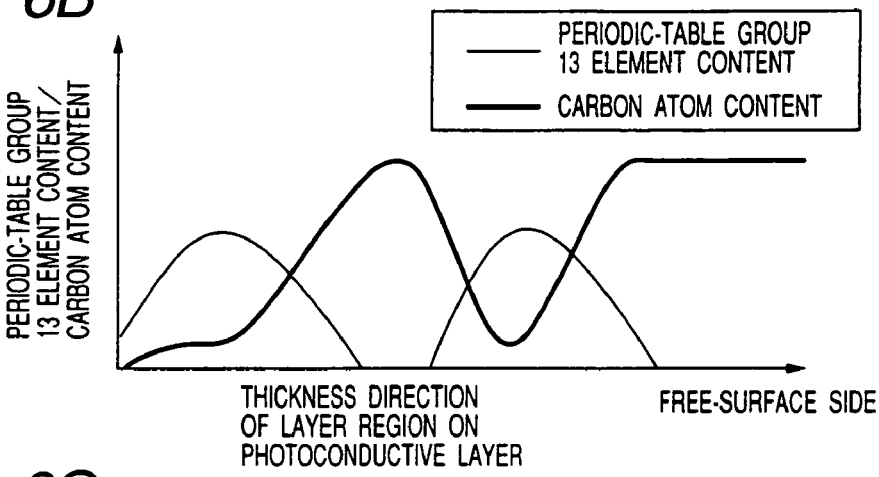

The content of carbon atoms in the intermediate layer and surface protective layer based on the total amount of constituent atoms was examined by secondary ion mass spectroscopy (SIMS) to find that its maximum value and maximum region value were each equally 70 atomic %. Distribution having a maximum value and a maximum region in the thickness direction of the amorphous-silicon layer as shown in FIGS. 4B and 6B was obtained by feeding source gas methane gas in order to incorporate carbon atoms.

Figure 5A:
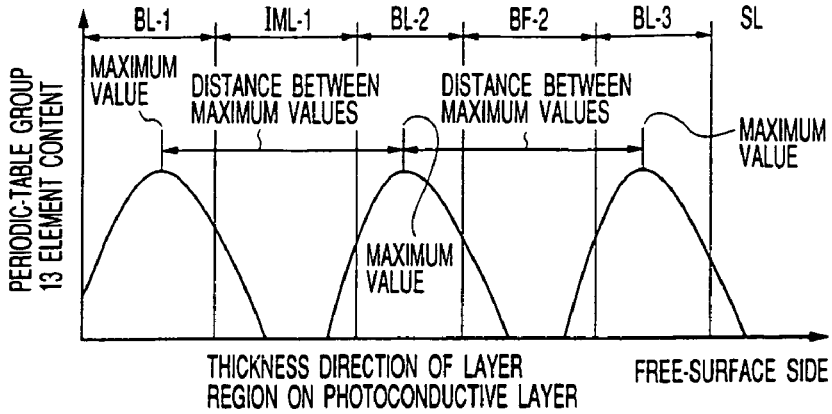
FIGS. 5A, 5B and 5C show distribution curves of the periodic-table Group 13 element content in the thickness direction of an amorphous-silicon layer region of an a-Si photosensitive member of the present invention.
Figure 5B:
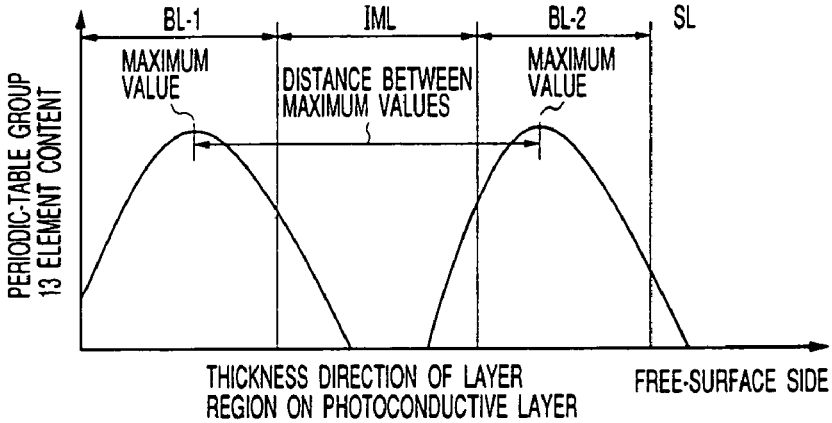

The first upper-part charge injection blocking layer and the second upper-part charge injection blocking layer were each equally in a layer thickness of 0.2 μm. Their periodic-table Group 13 element (B: boron) content was also examined by secondary ion mass spectroscopy (SIMS) to find that its maximum values were each equally 200 atomic ppm based on the total amount of constituent atoms. Distribution having two maximum values in the thickness direction of the amorphous-silicon layer as shown in FIGS. 5B and 6B was obtained by feeding source gas diborane gas in order to incorporate the periodic-table Group 13 element.

The minimum value between the two maximum values of the periodic-table Group 13 element content was 0 atomic ppm, and the distance between the same maximum values was 350 nm.

TABLE B-1

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 200 | 100 | 12 | 100 | 12 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 120 | 630 | 120 | 630 |

TABLE B-1-continued

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| Maximum value of periodic-table Group 13 element (B) content based on total amount of constituent atoms: (atomic ppm) | 0 | 0 | 200 | 0 | 200 | 0 |
| Maximum value or maximum region value of carbon atom content: (atomic %) | 0 | 0 | 18 | 70 | 18 | 70 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 600 | 330 | 150 | 330 | 150 |
| Layer thickness: (μm) | 3 | 32 | 0.2 | 0.15 | 0.2 | 0.5 |

Example B-2

Using the deposited-film formation apparatus of an RF-PCVD system as shown in FIG. 3, a lower-part charge injection blocking layer, a photoconductive layer, a first upper-part charge injection blocking layer (in FIGS. 4A and 5A, BL-1), a first intermediate layer (IML-1), a second upper-part charge injection blocking layer (BL-2), a second intermediate layer (IML-2), a third upper-part charge injection blocking layer (BL-3) and a surface protective layer (SL) were deposited on a mirror-finished cylindrical aluminum substrate of 80 mm in diameter under conditions shown in Table B-2, to produce a negative-charging electrophotographic photosensitive member.

As source gas for the periodic-table Group 13 element, diborane gas was used. As source gas for carbon atoms, methane gas was used.

The content of carbon atoms in the first intermediate layer, second intermediate layer and surface protective layer based on the total amount of constituent atoms was examined in the same manner as in Example B-1 to find that its maximum value and maximum region value were each equally 70 atomic %. Distribution having two maximum values and one maximum region in the thickness direction of the amorphous-silicon layer as shown in FIGS. 4A and 6A was obtained by feeding source gas methane gas in order to incorporate carbon atoms.

The first upper-part charge injection blocking layer, the second upper-part charge injection blocking layer and the third upper-part charge injection blocking layer were each equally in a layer thickness of 0.2 μm. Their periodic-table Group 13 element (B: boron) content was also examined by secondary ion mass spectroscopy (SIMS) to find that its maximum values were each equally 200 atomic ppm based on the total amount of constituent atoms. Distribution having three maximum values in the thickness direction of the amorphous-silicon layer as shown in FIGS. 5A and 6A was obtained by feeding source gas diborane gas in order to incorporate the periodic-table Group 13 element.

TABLE B-2

| Source gas & flow rate: | Lower-part charge injection blocking layer | Photo conductive layer | First upper-part charge injection blocking layer | First intermediate layer | Second upper-part charge injection blocking layer | Second intermediate layer | Third upper-part charge injection blocking layer | Surface protective layer |
|---|---|---|---|---|---|---|---|---|
| $SiH_4$ [ml/min(normal)] | 110 | 200 | 100 | 12 | 100 | 12 | 100 | 12 |
| $H_2$ [ml/min(normal)] | 500 | 800 | 0 | 0 | 0 | 0 | 0 | 0 |
| NO [ml/min(normal)] | 8 | 0 | 0 | 0 | 0 | 0 | 0 | 0 |
| $CH_4$ [ml/min(normal)] | 0 | 0 | 120 | 630 | 120 | 630 | 120 | 630 |
| Maximum value of periodic-table Group 13 element (B) content based on total amount of constituent atoms: (atomic ppm) | 0 | 0 | 200 | 0 | 200 | 0 | 200 | 0 |
| Maximum value or maximum region value of carbon atom content: (atomic %) | 0 | 0 | 18 | 70 | 3 | 70 | 18 | 70 |
| Substrate temperature: (° C.) | 260 | 260 | 260 | 260 | 260 | 260 | 260 | 260 |
| Reactor internal pressure: (Pa) | 64 | 79 | 60 | 60 | 60 | 60 | 60 | 60 |

TABLE B-2-continued

| Source gas & flow rate: | Lower-part charge injection blocking layer | Photo conductive layer | First upper-part charge injection blocking layer | First intermediate layer | Second upper-part charge injection blocking layer | Second intermediate layer | Third upper-part charge injection blocking layer | Surface protective layer |
|---|---|---|---|---|---|---|---|---|
| High-frequency power: (W) (13.56 MHz) | 150 | 600 | 330 | 150 | 330 | 150 | 330 | 150 |
| Layer thickness: ($\mu$m) | 3 | 32 | 0.2 | 0.15 | 0.2 | 0.15 | 0.2 | 0.5 |

Comparative Example B-1

In this Comparative Example, the procedure of Example B-1 was repeated except that only the lower-part charge injection blocking layer, photoconductive layer, first upper-part charge injection blocking layer and surface protective layer were deposited on the mirror-finished cylindrical aluminum substrate under conditions shown in Table B-3, to produce a negative-charging electrophotographic photosensitive member.

Figure 4C:
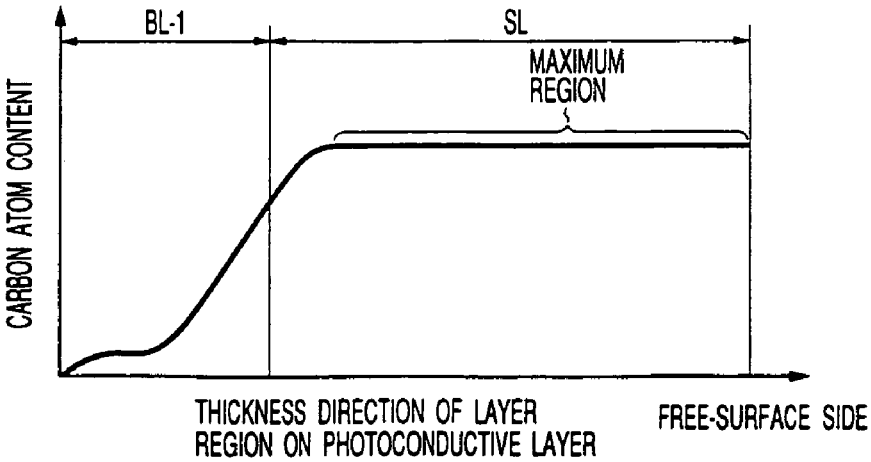
Figure 6C:
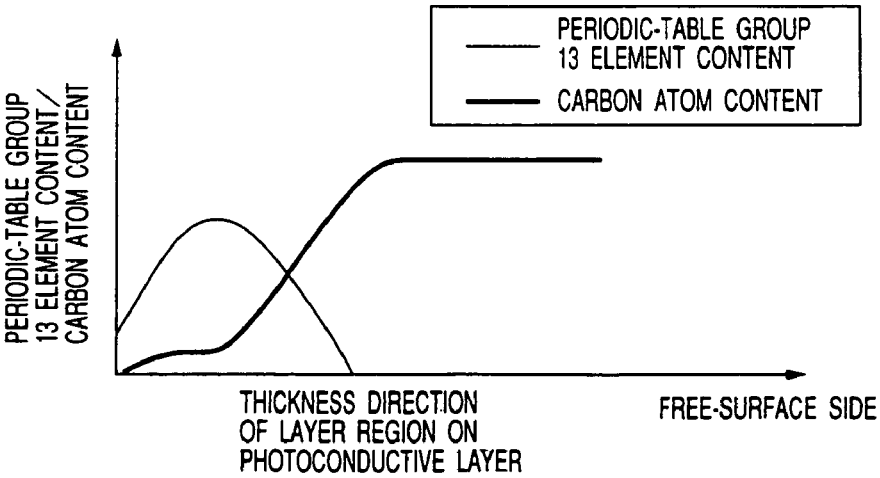

In this Comparative Example, the content of carbon atoms in the surface protective layer had the same maximum region value as that in Example B-1, 70 atomic % based on the total amount of constituent atoms. Since, however, any intermediate layer was not deposited in this Comparative Example, distribution having only one maximum region value in the thickness direction of the amorphous-silicon layer as shown in FIGS. 4C and 6C was obtained.

Figure 5C:
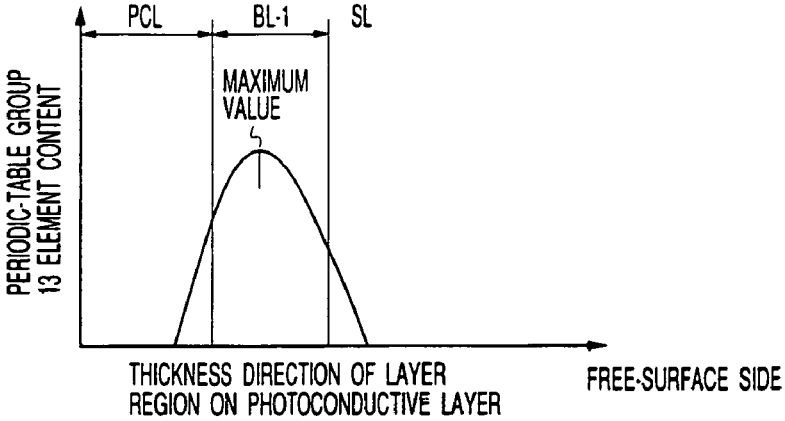

The first upper-part charge injection blocking layer in this Comparative Example was in a layer thickness of 0.2 $\mu$m, which was the same as that in Example B-1. Its periodic-table Group 13 element (B: boron) content was also examined by secondary ion mass spectroscopy (SIMS) to find that its maximum value was 200 atomic ppm based on the total amount of constituent atoms, which was the same as that in Example B-1. Since, however, the second upper-part charge injection blocking layer was also not deposited in this Comparative Example, distribution having only one maximum value in the thickness direction of the amorphous-silicon layer as shown in FIGS. 5C and 6C was obtained.

TABLE B-3

| Source gas & flow rate: | Lower-part charge injection blocking layer | Photo-conductive layer | Upper-part charge injection blocking layer | Surface protective layer |
|---|---|---|---|---|
| $SiH_4$ [ml/min(normal)] | 110 | 200 | 100 | 12 |
| $H_2$ [ml/min(normal)] | 500 | 800 | 0 | 0 |
| NO [ml/min(normal)] | 8 | 0 | 0 | 0 |
| $CH_4$ [ml/min(normal)] | 0 | 0 | 120 | 630 |
| Maximum value of periodic-table Group 13 element (B) content based on total amount of constituent atoms: (atomic ppm) | 0 | 0 | 200 | 0 |
| Maximum value or maximum region value of carbon atom content: (atomic %) | 0 | 0 | 18 | 70 |
| Substrate temperature: (° C.) | 260 | 260 | 260 | 260 |
| Reactor internal pressure: (Pa) | 64 | 79 | 60 | 60 |
| High-frequency power: (W) (13.56 MHz) | 150 | 600 | 330 | 150 |
| Layer thickness: ($\mu$m) | 3 | 32 | 0.2 | 0.5 |

The negative-charging electrophotographic photosensitive members produced in Examples B-1 and B-2, and Comparative Example B-1 were each set in an electrophotographic apparatus (a remodeled machine of iR6000, trade name, manufactured by CANON INC.; remodeled for evaluation in a negative-charging system) to make evaluation on the evaluation items described below. The results of evaluation are shown in Table B-4.

In respect of "pressure mar test", "charging performance" and "sensitivity", evaluation was made in the same manner as in Example A-1 except that relative evaluation was made regarding as 100% the values obtained in Comparative Example B-1.

Smeared Images:

The negative-charging electrophotographic photosensitive members produced were each set in an electrophotographic apparatus (a remodeled machine of iR6000, trade name, manufactured by CANON INC.; remodeled for evaluation in a negative-charging system), and copies were continuously taken on 100,000 sheets in an environment of high temperature/high humidity of 30° C./80% RH and without use of any heating means such as a drum heater to conduct a running test. In this test, a magnet roller was brought into contact rotating it in the counter direction at a higher speed than that in usual service and a cleaning blade was pressed at a higher pressure than that in usual service to set up an environment where the load on the photosensitive member surface that was caused by friction was severer. As a copying original, a test chart available from CANON INC. (parts number: FY99058) was used. Before and after this running test, copied images of fine lines of the test chart were evaluated.

A: Very good images free of any blur in the fine lines even when examined with a magnifier.

B: Images are seen to be a little blurred in the fine lines when examined with a magnifier, but at the level not recognizable with the naked eye. Good images.

C: Images are seen to be a little blurred in the fine lines when examined with the naked eye, but at the level of no problem in practical use.

Cleaning Performance:

The negative-charging electrophotographic photosensitive members produced were each set in an electrophotographic apparatus (a remodeled machine of iR6000, trade name, manufactured by CANON INC.; remodeled for evaluation in a negative-charging system), and a continuous paper feed running test on A4-size 100,000 sheets was conducted at a photosensitive member movement speed of 300 mm/sec to evaluate cleaning performance. Here, as an elastic rubber blade, a urethane rubber blade with an impact resilience of 10% was used. In regard to a develope used, a developer with an average particle diameter of 6.5 $\mu$m was used because the developer more tends to melt-adhere as it has smaller particle diameter. Further, the surface temperature of the photosensitive member was controlled to 60° C. to provide a condition in which the developer tends to melt-adhere.

A: Very good images free of any faulty-cleaning marks and blank lines.

B: There are two or less faulty-cleaning marks of 1 mm or less in width and 1 cm or less in length, but at the level of no problem in practical use.

C: Three or more faulty-cleaning marks appear which are of 1 mm or less in width and 1 cm or less in length, or faulty-cleaning marks appears which are of 1 mm or more in width and 1 cm or more in length.

Depth of Wear:

The negative-charging electrophotographic photosensitive members produced were each set in an electrophotographic apparatus (a remodeled machine of iR6000, trade name, manufactured by CANON INC.; remodeled for evaluation in a negative-charging system), and a continuous paper feed running test on A4-size 100,000 sheets was conducted at a photosensitive member movement speed of 300 mm/sec. The layer thickness of the surface protective layer before and after the running test was measured with a reflection spectral interferometer (trade name: MCPD-2000; manufactured by Ohtsuka Denshi K.K.).

A: The surface protective layer is in a layer thickness loss of less than 50 nm, and is in a very good state.

B: The surface protective layer is in a layer thickness loss of from 50 nm or more to less than 100 nm, but at the level of no problem in practical use.

Melt Adhesion:

The negative-charging electrophotographic photosensitive members produced were each set in an electrophotographic apparatus (a remodeled machine of iR6000, trade name, manufactured by CANON INC.; remodeled for evaluation in a negative-charging system), and images were reproduced to form A3-size solid white images. On the images thus formed, black dots caused by melt adhesion of toner and melt-adhesion present on the surface of each electrophotographic photosensitive member produced were observed on a microscope.

A: Neither black spots nor melt-adhesion is seen, enjoying a very good state.

B: Black spots are not seen, but microscopic melt-adhesion is seen when the surface of the electrophotographic photosensitive member produced is observed on a microscope, which, however, is at five spots or less, keeping a good state.

C: Black spots are not seen, but microscopic melt-adhesion is seen when the surface of the electrophotographic photosensitive member produced is observed on a microscope, which, however, is at ten spots or less and at the level of no problem in practical use.

Overall Evaluation:

Evaluation was made on all the evaluation items, and the results were ranked.

AA: All ranked as "A" on all the evaluation items, and at a very good level.

A: All ranked as "A" or "B" on all the evaluation items, having "A"'s in a large proportion, and at a good level.

B: All ranked as "A" or "B" on all the evaluation items, having "B"'s in a large proportion, and at a little good level.

C: At least one is ranked as "C" on all the evaluation items, but at the level of no problem in practical use.

TABLE B-4

| | Example B-1 | Example B-2 | Comparative Example B-1 |
|---|---|---|---|
| Smeared images: | A | A | C |
| Cleaning performance: | A | A | B |
| Depth of wear: | A | A | B |
| Melt-adhesion: | B | B | C |
| Pressure mar test: | B | B | C |
| Charging performance: | B | B | C |
| Sensitivity: | A | A | C |
| Overall evaluation: | B | B | C |

As can be seen from the results shown in Table B-4, it has been ascertained that the construction where the maximum values or maximum regions of carbon atom content and the maximum values of the periodic-table Group 13 element (B: boron) content are distributed at least two by two in the layer region deposited on the photoconductive layer brings good effects in respect of all the evaluation items of smeared images, cleaning performance, depth of wear, melt-adhesion, pressure mar test, charging performance and sensitivity.

Example B-3

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-5, to produce a negative-charging electrophotographic photosensitive member.

As source gas for the periodic-table Group 13 element, diborane gas was used. As source gas for carbon atoms, methane gas was used.

In this Example, the flow rate of the carbon source $CH_4$ gas was changed to change the content of carbon atoms in the intermediate layer based on the total amount of constituent atoms, to produce negative-charging electrophotographic photosensitive members in which its maximum region value was from 4 atomic % to 96 atomic %.

Figure 7A:
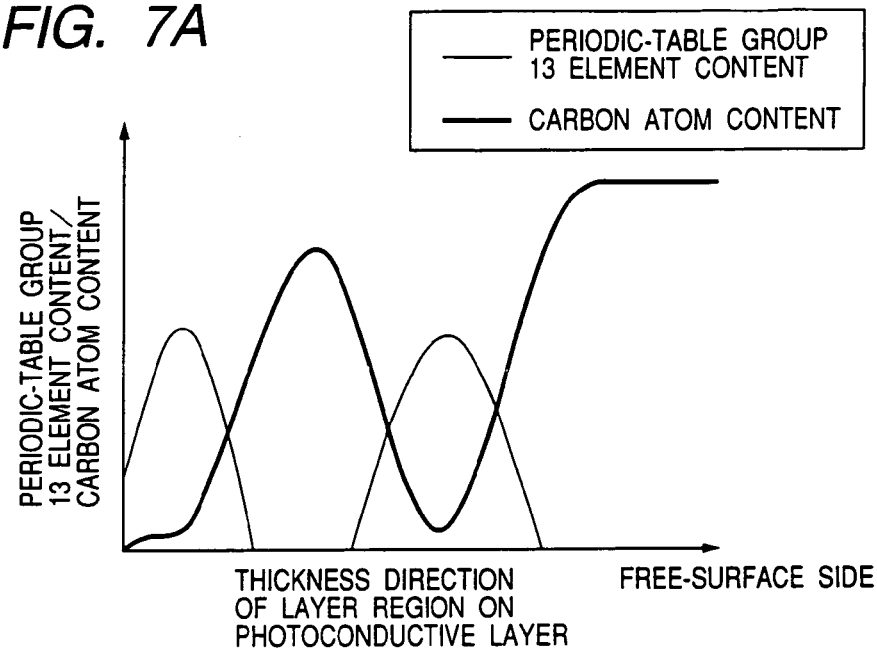
FIGS. 7A and 7B show distribution curves of the carbon atom content and periodic-table Group 13 element content in the thickness direction of an amorphous-silicon layer region of an a-Si photosensitive member of the present invention.
Figure 7B:
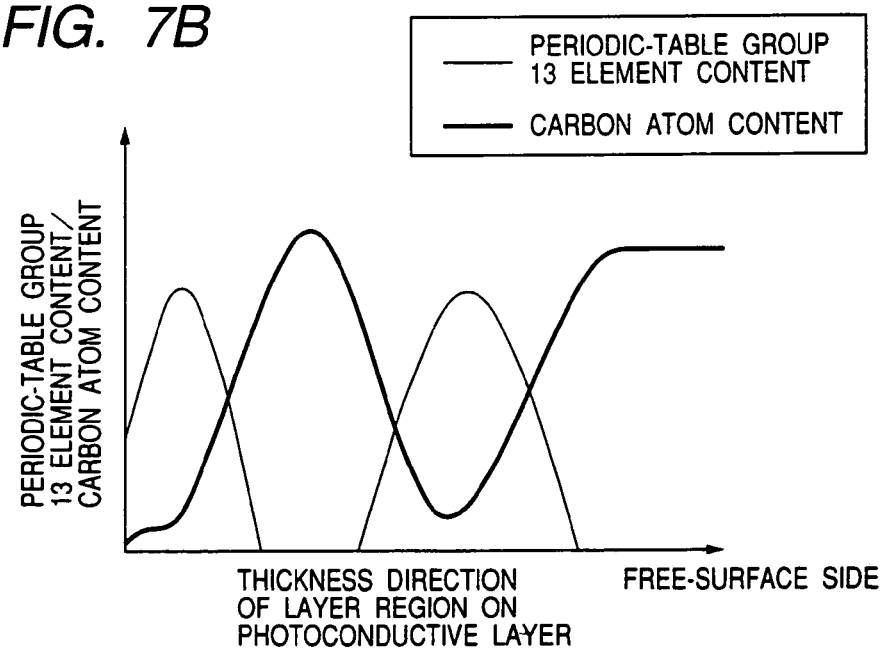

The maximum region value of the content of carbon atoms in the surface protective layer was set to 80 atomic % based on the total amount of constituent atoms. Distribution having a maximum value and a maximum region in the thickness direction of the amorphous-silicon layer as shown in FIG. 6B and FIGS. 7A and 7B was obtained by feeding source gas methane gas in order to incorporate carbon atoms.

The first upper-part charge injection blocking layer and the second upper-part charge injection blocking layer were each equally in a layer thickness of 0.2 $\mu$m. Their periodic-table Group 13 element (B: boron) content was also examined by secondary ion mass spectroscopy (SIMS) to find that its maximum values were each equally 200 atomic ppm based on the total amount of constituent atoms. Distribution having two maximum values in the thickness direction of the amorphous-silicon layer as shown in FIGS. 5B and 6B was obtained by feeding source gas diborane gas in order to incorporate the periodic-table Group 13 element.

The minimum value between the two maximum values of the periodic-table Group 13 element content was 0 atomic ppm, and the distance between the same maximum values was 350 nm.

TABLE B-5

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 400 | 90 | 4 to 300 | 100 | 12 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 100 | 50 to 630 | 120 | 630 |
| Maximum value of periodic-table Group 13 element (B) content based on total amount of constituent atoms: (atomic ppm) | 0 | 0 | 200 | 0 | 200 | 0 |
| Maximum value or maximum region value of carbon atom content: (atomic %) | 0 | 0 | 15 | 4 to 96 | 18 | 80 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 700 | 330 | 130 | 300 | 180 |
| Layer thickness: ($\mu$m) | 3 | 30 | 0.2 | 0.15 | 0.2 | 0.5 |

The negative-charging electrophotographic photosensitive members produced in this Example were each set in an electrophotographic apparatus (a remodeled machine of iR6000, trade name, manufactures by CANON INC.; remodeled for evaluation in a negative-charging system) to make evaluation on the same evaluation items as those in Example B-1. The results of evaluation are shown in Table B-6.

TABLE B-6

| Example B-3 | Maximum region value of carbon atom content: (atomic %) 4 | 5 | 10 | 30 | 40 | 60 | 70 | 80 | 90 | 95 | 96 |
|---|---|---|---|---|---|---|---|---|---|---|---|
| Smeared images: | B | B | B | B | A | A | A | A | A | A | A |
| Cleaning performance: | A | A | A | A | A | A | A | A | A | A | A |
| Depth of wear: | A | A | A | A | A | A | A | A | A | A | A |
| Melt-adhesion: | A | A | A | A | A | A | A | A | A | A | A |
| Pressure mar test: | B | B | B | B | B | B | B | B | B | B | B |
| Charging performance: | C | C | B | B | B | B | B | B | B | B | B |
| Sensitivity: | A | A | A | A | A | A | A | A | A | A | B |
| Overall evaluation: | C | C | B | B | B | B | B | B | B | B | B |

As can be seen from the results shown in Table B-6, the seared images show a tendency to occur seriously when the maximum value of the carbon atom content distributed in the intermediate layer is less than 40 atomic %, and the sensitivity shows a tendency to lower when it is more than 95 atomic %. From these facts, it is seen that the maximum value of the carbon atom content in the intermediate layer may preferably be in the range of from 40 atomic % to 95 atomic %.

It is also seen that good results are obtained in respect of the evaluation item of the melt adhesion when the distribution is given in which the carbon atom content in the surface protective layer is larger than the carbon atom content in the intermediate layer as shown in FIG. 7A.

Example B-4

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-7, to produce a negative-charging electrophotographic photosensitive member.

As source gas for the periodic-table Group 13 element, diborane gas was used. As source gas for carbon atoms, methane gas was used.

In this Example, the flow rate of the carbon source $CH_4$ gas was changed to change the content of carbon atoms in the surface protective layer based on the total amount of constituent atoms, to produce negative-charging electrophotographic photosensitive members in which its maximum region value was from 4 atomic % to 96 atomic %.

The maximum value of the content of carbon atoms in the intermediate layer was set to 50 atomic % based on the total amount of constituent atoms. Distribution having a maximum value and a maximum region in the thickness direction of the amorphous-silicon layer as shown in FIG. 6B and FIGS. 7A and 7B was obtained by feeding source gas methane gas in order to incorporate carbon atoms.

The first upper-part charge injection blocking layer and the second upper-part charge injection blocking layer were each equally in a layer thickness of 0.2 $\mu$m. Their periodic-table Group 13 element (B: boron) content was also examined by secondary ion mass spectroscopy (SIMS) to find that its maximum values were each equally 200 atomic ppm based on the total amount of constituent atoms. Distribution having two maximum values in the thickness direction of the amorphous-silicon layer as shown in FIGS. 5B and 6B was obtained by feeding source gas diborane gas in order to incorporate the periodic-table Group 13 element.

The minimum value between the two maximum values of the periodic-table Group 13 element content was 0 atomic ppm, and the distance between the same maximum values was 350 nm.

TABLE B-7

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 400 | 90 | 10 | 100 | 4 to 300 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 100 | 580 | 120 | 50 to 630 |
| Maximum value of periodic-table Group 13 element (B) content based on total amount of constituent atoms: (atomic ppm) | 0 | 0 | 200 | 0 | 200 | 0 |
| Maximum value or maximum region value of carbon atom content: (atomic %) | 0 | 0 | 15 | 50 | 18 | 4 to 96 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 700 | 330 | 130 | 300 | 150 |
| Layer thickness: ($\mu$m) | 3 | 30 | 0.2 | 0.15 | 0.2 | 0.5 |

The negative-charging electrophotographic photosensitive members produced in this Example were each set in an electrophotographic apparatus (a remodeled machine of iR6000, trade name, manufactured by CANON INC.; remodeled for evaluation in a negative-charging system) to make evaluation on the same evaluation items as those in Example B-1. The results of evaluation are shown in Table B-8.

TABLE B-8

| | Maximum region value of carbon atom content: (atomic %) | | | | | | | | | | |
|---|---|---|---|---|---|---|---|---|---|---|---|
| Example B-4 | 4 | 5 | 10 | 30 | 40 | 50 | 60 | 80 | 90 | 95 | 96 |
| Smeared images: | A | A | A | A | A | A | A | A | A | A | A |
| Cleaning performance: | A | A | A | A | A | A | A | A | A | A | A |
| Depth of wear: | B | B | B | B | A | A | A | A | A | A | A |
| Melt-adhesion: | B | B | B | B | B | B | A | A | A | A | A |
| Pressure mar test: | B | B | B | B | B | B | B | B | B | B | B |
| Charging performance: | B | B | B | B | B | B | B | B | B | B | B |
| Sensitivity: | A | A | A | A | A | A | A | A | A | A | B |
| Overall evaluation: | C | C | C | C | B | B | B | B | B | B | B |

As can be seen from the results shown in Table B-8, the depth of wear shows a tendency to worsen when the maximum region value of the carbon atom content distributed in the surface protective layer is less than 40 atomic %, and the sensitivity shows a tendency to lower when it is more than 95 atomic %. From these facts, it is seen that the maximum region value of the carbon atom content in the surface protective layer may preferably be in the range of from 40 atomic % to 95 atomic %.

It is also seen that, like the results in Example B-3, good results are obtained in respect of the evaluation item of the melt adhesion when the distribution is given in which the carbon atom content in the intermediate layer and that in the surface protective layer are not equal to each other and the carbon atom content in the surface protective layer is larger than the carbon atom content in the intermediate layer as shown in FIG. 7A.

Example B-5

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-9, to produce a negative-charging electrophotographic photosensitive member.

TABLE B-9

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 400 | 90 | 10 | 100 | 12 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 100 | 550 | 120 | 600 |
| Maximum value of periodic-table Group 13 element (B) content based on total amount of constituent atoms: (atomic ppm) | 0 | 0 | 200 | 0 | 200 | 0 |
| Maximum value or maximum region value of carbon atom content: (atomic %) | 0 | 0 | 21 | 45 | 25 | 75 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 700 | 350 | 100 | 330 | 130 |
| Layer thickness: (μm) | 3 | 30 | 0.2 | 0.07 to 0.15 | 0.01 to 2.9 | 0.07 to 0.3 |

As source gas for the periodic-table Group 13 element, diborane gas was used. As source gas for carbon atoms, methane gas was used.

In this Example, the maximum value and maximum region value of the content of carbon atoms in the intermediate layer and surface protective layer based on the total amount of constituent atoms were 45 atomic % and 75 atomic %, respectively. Distribution having a maximum value and a maximum region value in the thickness direction of the amorphous-silicon layer and in which the maximum region value, positioned on the outermost surface protective layer side, was largest as shown in FIG. 7A was obtained by feeding source gas methane gas in order to incorporate carbon atoms.

The periodic-table Group 13 element (B: boron) content of the first upper-part charge injection blocking layer and second upper-part charge injection blocking layer was also examined by secondary ion mass spectroscopy (SIMS) to find that its maximum values were each equally 200 atomic ppm based on the total amount of constituent atoms. Distribution having two maximum values in the thickness direction of the amorphous-silicon layer as shown in FIGS. 5B and 7A was obtained by feeding source gas diborane gas in order to incorporate the periodic-table Group 13 element. The minimum value between the two maximum values was 0 ppm.

In this Example, the deposited-film formation time for the intermediate layer and that for the second upper-part charge injection blocking layer were changed to change the layer thickness of the intermediate layer and second upper-part charge injection blocking layer; to produce negative-charging electrophotographic photosensitive members in which the distance between the maximum value of the carbon atom content and the maximum region value thereof, shown in FIG. 4B, was changed as shown in Table B-10.

The negative-charging electrophotographic photosensitive members produced in this Example were each set in an electrophotographic apparatus (a remodeled machine of iR6000, trade name, manufactured by CANON INC.; remodeled for evaluation in a negative-charging system) to make evaluation on the same evaluation items as those in Example B-1. The results of evaluation are shown in Table B-10.

TABLE B-10

| | Distance between maximum value and maximum region value: (nm) | | | | | | |
|---|---|---|---|---|---|---|---|
| Example B-5 | 80 | 100 | 500 | 1,000 | 2,000 | 3,000 | 3,100 |
| Smeared images: | A | A | A | A | A | A | A |
| Cleaning performance: | A | A | A | A | A | A | A |
| Depth of wear: | A | A | A | A | A | A | A |
| Melt-adhesion: | A | A | A | A | A | A | A |
| Pressure mar test: | B | B | B | B | B | B | B |
| Charging performance: | C | B | B | B | B | B | B |
| Sensitivity: | A | A | A | A | A | A | B |
| Overall evaluation: | C | B | B | B | B | B | B |

As can be seen from the results shown in Table B-10, when the distance between the maximum value of the carbon atom content and the maximum region value thereof distributed in the layer region deposited on the photoconductive layer is less than 100 nm, the second upper-part charge injection blocking layer has so small layer thickness as to cause a lowering of charging performance. When the distance is more than 3,000 nm, the second upper-part charge injection blocking layer has so excessively large layer thickness that the sensitivity shows a tendency to lower. Accordingly, it is seen that the distance between the maximum value of the carbon atom content and the maximum region value thereof distributed in the layer region deposited on the photoconductive layer may preferably be from 100 nm to 3,000 nm.

Figure 8A:
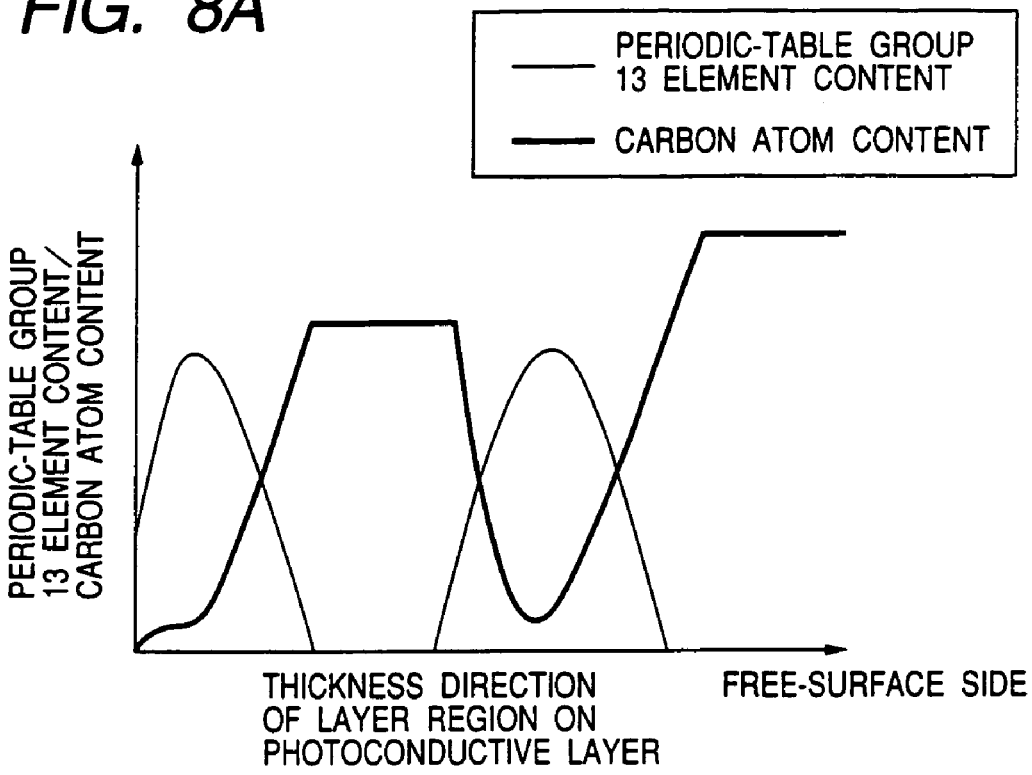
FIGS. 8A and 8B show distribution curves of the carbon atom content and periodic-table Group 13 element content in the thickness direction of an amorphous-silicon layer region of an a-Si photosensitive member of the present invention.
Figure 8B:
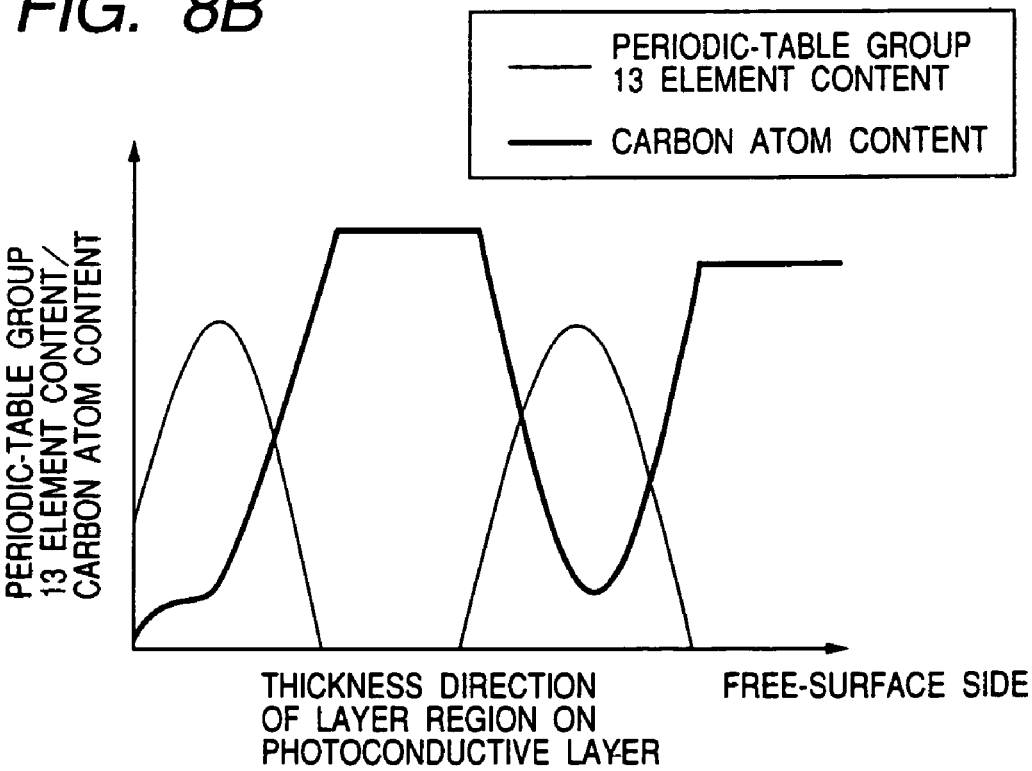

The periodic-table Group 13 element (B: boron) content of the first upper-part charge injection blocking layer and second upper-part charge injection blocking layer was also examined by secondary ion mass spectroscopy (SIMS) to find that its maximum values were each equally 250 atomic ppm based on the total amount of constituent atoms. Distribution having two maximum values in the thickness direction of the amorphous-silicon layer as shown in FIGS. 8A and 8B was obtained by feeding source gas diborane gas in order to incorporate the periodic-table Group 13 element.

TABLE B-11

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 200 | 100 | 12 to 80 | 100 | 12 to 80 |
| $H_2$ [(ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 120 | 160 to 630 | 120 | 160 to 630 |
| Maximum value of periodic-table Group 13 element (B) content based on total amount of constituent atoms: (atomic ppm) | 0 | 0 | 250 | 0.3 | 250 | 0.2 |
| Maximum value or maximum region value of carbon atom content: (atomic %) | 0 | 0 | 14 | 60 to 90 | 14 | 60 to 90 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 600 | 290 | 150 | 290 | 150 |
| Layer thickness: (μm) | 3 | 32 | 0.2 | 0.4 | 0.2 | 0.5 |

Example B-6

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-11, to produce a negative-charging electrophotographic photosensitive member.

As source gas for the periodic-table Group 13 element, diborane gas was used. As source gas for carbon atoms, methane gas was used.

In this Example, the flow rate of the carbon source $CH_4$ gas was changed to change the content of carbon atoms in the intermediate layer and surface protective layer based on the total amount of constituent atoms, to produce negative-charging electrophotographic photosensitive members in which the state of distribution of two maximum region values was changed as shown below.

FIG. 8A: The state of distribution that the maximum region value on the outermost surface protective layer side, of the carbon atom content based on the total amount of constituent atoms is largest.

FIG. 8B: The state of distribution that the maximum region value on the photoconductive layer side, of the carbon atom content based on the total amount of constituent atoms is largest.

The negative-charging electrophotographic photosensitive members produced in this Example were each set in an electrophotographic apparatus (a remodeled machine of iR6000, trade name, manufactured by CANON INC.; remodeled-for evaluation in a negative-charging system) to make evaluation on the same evaluation items as those in Example B-1. The results of evaluation are shown in Table B-12.

The results of evaluation in Example B-5 in respect of the case in which the distance between maximum value and maximum region value was 1,000 nm are also shown in Table B-12.

TABLE B-12

| | Example B-6 | | Example B-5 |
|---|---|---|---|
| | FIG. 8A | FIG. 8B | FIG. 7A |
| Smeared images: | A | A | A |
| Cleaning performance: | A | A | A |
| Depth of wear: | A | A | A |
| Melt-adhesion: | A | B | A |
| Pressure mar test: | B | B | B |
| Charging performance: | B | B | B |
| Sensitivity: | A | A | A |
| Overall evaluation: | B | B | B |

As can be seen from the results shown in Table B-12, it has been ascertained that, where the state of distribution of the carbon atom content distributed in the layer region deposited on the photoconductive layer is changed, good results are obtained by providing the state of distribution that the maximum region value of the carbon atom content on the outermost surface protective layer side is largest.

Example B-7

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-13, to produce a negative-charging electrophotographic photosensitive member.

As source gas for the periodic-table Group 13 element, diborane gas was used. As source gas for carbon atoms, methane gas was used.

In this Example, the maximum value and maximum region value of the content of carbon atoms in the intermediate layer and surface protective layer were 60 atomic % and 75 atomic %, respectively, based on the total amount of constituent atoms. Distribution having a maximum value and a maximum region in the thickness direction of the amorphous-silicon layer and in which the maximum region value on the outermost surface protective layer side is largest as shown in FIG. 7A was obtained by feeding source gas methane gas in order to incorporate carbon atoms.

In this Example, the deposited-film formation time for the intermediate layer was changed to change the layer thickness of the intermediate layer, to produce negative-charging electrophotographic photosensitive members in which the distance between two maximum values of the periodic-table Group 13 (B: boron) element content distributed in the layer region deposited on the photoconductive layer was changed to be from 80 nm or more to 1,200 nm or less.

The first upper-part charge injection blocking layer and the second upper-part charge injection blocking layer were each equally in a layer thickness of 0.2 $\mu$m. Their periodic-table Group 13 element (B: boron) content was also examined by secondary ion mass spectroscopy (SIMS) to find that its maximum values were each equally 300 atomic ppm based on the total amount of constituent atoms. Distribution having two maximum values in the thickness direction of the amorphous-silicon layer as shown in FIG. 7A was obtained by feeding source gas diborane gas in order to incorporate the periodic-table Group 13 element. The minimum value between these two maximum values was 0.2 atomic ppm.

TABLE B-13

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 400 | 100 | 12 | 100 | 12 |
| $H_2$ [ml/min(normal)] | 500 | 1,200 | 0 | 0 | 0 | 0 |
| NO [ml/min(normal)] | 8 | 0 | 0 | 0 | 0 | 0 |
| $CH_4$ [ml/min(normal)] | 0 | 0 | 120 | 630 | 120 | 630 |
| Maximum value of periodic-table Group 13 element (B) content based on total amount of constituent atoms: (atomic ppm) | 0 | 0 | 300 | 0.2 | 300 | 0.3 |
| Maximum value or maximum region value of carbon atom content: (atomic %) | 0 | 0 | 15 | 60 | 15 | 75 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHz) | 150 | 600 | 350 | 150 | 350 | 160 |
| Layer thickness: ($\mu$m) | 3 | 32 | 0.07 to 0.1 | 0.01 to 1.1 | 0.07 to 0.1 | 0.5 |

The negative-charging electrophotographic photosensitive members produced in this Example were each set in an electrophotographic apparatus (a remodeled machine of iR6000, trade name, manufactured by CANON INC.; remodeled for evaluation in a negative-charging system) to make evaluation on the same evaluation items as those in Example B-1. The results of evaluation are shown in Table B-14.

TABLE B-14

| | Distance between maximum values: (nm) | | | | | | |
|---|---|---|---|---|---|---|---|
| Example B-7 | 80 | 90 | 100 | 500 | 1,000 | 1,100 | 1,200 |
| Smeared images: | A | A | A | A | A | A | A |
| Cleaning performance: | A | A | A | A | A | A | A |
| Depth of wear: | A | A | A | A | A | A | A |
| Melt-adhesion: | A | A | A | A | A | A | A |
| Pressure mar test: | B | B | A | A | A | A | A |
| Charging performance: | B | B | B | B | B | C | C |
| Sensitivity: | A | A | A | A | A | A | A |
| Overall evaluation: | B | B | A | A | A | C | C |

As can be seen from the results shown in Table B-14, good results are obtained on overall evaluation when the distance between the maximum values of the periodic-table Group 13 element content distributed in the layer region deposited on the photoconductive layer is in the range of from 100 nm to 1,000 nm in the thickness direction of the amorphous-silicon layer.

Example B-8

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-15, to produce a negative-charging electrophotographic photosensitive member.

As source gas for the periodic-table Group 13 element, diborane gas was used. As source gas for carbon atoms, methane gas was used.

In this Example, the maximum value and maximum region value of the content of carbon atoms in the intermediate layer and surface protective layer were 65 atomic % and 85 atomic %, respectively, based on the total amount of constituent atoms. Distribution having a maximum value and a maximum region in the thickness direction of the amorphous-silicon layer and in which the maximum region value on the outermost surface protective layer side is largest as shown in FIG. 7A was obtained by feeding source gas methane gas in order to incorporate carbon atoms.

The first upper-part charge injection blocking layer and the second upper-part charge injection blocking layer were each equally in a layer thickness of 0.2 $\mu$m, provided that, in this Example, the flow rate of the boron source diborane gas was changed to change the periodic-table Group 13 element (B: boron) content based on the total amount of constituent atoms contained in the first upper-part charge injection blocking layer, to produce negative-charging electrophotographic photosensitive members in which the maximum value on the photoconductive-layer side was changed as shown in Table B-16.

The periodic-table Group 13 element (B: boron) content based on the total amount of constituent atoms contained in the first upper-part charge injection blocking layer was also examined by secondary ion mass spectroscopy (SIMS) to find that its maximum was 300 atomic ppm based on the total amount of constituent atoms. Distribution having two maximum values in the thickness direction of the amorphous-silicon layer as shown in FIG. 7A was obtained by feeding source gas diborane gas in order to incorporate the periodic-table Group 13 element.

TABLE B-15

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 200 | 80 | 60 | 80 | 12 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 130 | 200 | 130 | 590 |
| Maximum value of periodic-table Group 13 element (B) content based on total amount of constituent atoms: (atomic ppm) | 0 | 0 | 80 to 1,500 | 0 | 300 | 0 |
| Maximum value or maximum region value of carbon atom content: (atomic %) | 0 | 0 | 23 | 65 | 23 | 85 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) (13.56 MHZ) | 150 | 600 | 330 | 150 | 330 | 150 |
| Layer thickness: ($\mu$m) | 3 | 32 | 0.2 | 0.2 | 0.2 | 0.5 |

The negative-charging electrophotographic photosensitive members produced in this Example were each set in an electrophotographic apparatus (a remodeled machine of iR6000, trade name, manufactured by CANON INC.; remodeled for evaluation in a negative-charging system) to make evaluation on the same evaluation items as those in Example B-1. The results of evaluation are shown in Table B-16.

TABLE B-16

| | Maximum value of periodic-table Group 13 (B) element content: (atomic ppm) | | | | | |
|---|---|---|---|---|---|---|
| Example B-8 | 80 | 90 | 100 | 200 | 400 | 1,500 |
| Smeared images: | A | A | A | A | A | A |
| Cleaning performance: | A | A | A | A | A | A |
| Depth of wear: | A | A | A | A | A | A |
| Melt-adhesion: | A | A | A | A | A | A |
| Pressure mar test: | A | A | A | A | A | A |
| Charging performance: | C | C | B | B | B | B |
| Sensitivity: | A | A | A | A | A | A |
| Overall evaluation: | C | C | A | A | A | A |

As can be seen from the results shown in Table B-16, good results are obtained on overall evaluation when the maximum value on the photoconductive layer side, of the periodic-table Group 13 element content distributed in the layer region deposited on the photoconductive layer is in the range of 100 atomic ppm or more to 1,500 atomic ppm or less.

Example B-9

Using the deposited-film formation apparatus of an RF-PCVD system as shown in FIG. 3, a lower-part charge injection blocking layer, a photoconductive layer, a first upper-part charge injection blocking layer, an intermediate layer, a second upper-part charge injection blocking layer and a surface protective layer were deposited on a mirror-finished cylindrical aluminum substrate of 80 mm in diameter under conditions shown in Table B-17, to produce a negative-charging electrophotographic photosensitive member.

TABLE B-17

| Source gas & flow rate: | Lower-part charge injection blocking layer | Photo conductive layer | First upper-part charge injection blocking layer | Intermediate layer | Second upper-part charge injection blocking layer | Surface protective layer |
|---|---|---|---|---|---|---|
| $SiH_4$ [ml/min(normal)] | 110 | 200 | 90 | 60 | 90 | 12 |
| $H_2$ [ml/min(normal)] | 500 | 800 | 0 | 0 | 0 | 0 |
| NO [ml/min(normal)] | 8 | 0 | 0 | 0 | 0 | 0 |
| $CH_4$ [ml/min(normal)] | 0 | 0 | 95 | 200 | 95 | 630 |
| Maximum value of periodic-table Group 13 element (B) content based on total amount of constituent atoms: (atomic ppm) | 0 | 0 | 150, 500 | 0 | 150, 500 | 0 |
| Maximum value or maximum region value of carbon atom content: (atomic %) | 0 | 0 | 18 | 60 | 18 | 90 |
| Substrate temperature: (° C.) | 260 | 260 | 260 | 260 | 260 | 260 |
| Reactor internal pressure: (Pa) | 64 | 79 | 60 | 60 | 60 | 60 |
| High-frequency power: (W) | 150 | 600 | 330 | 150 | 330 | 210 |
| Layer thickness: ($\mu$m) | 3 | 32 | 0.2 | 0.2 | 0.2 | 0.5 |

As source gas for the periodic-table Group 13 element, diborane gas was used. As source gas for carbon atoms, methane gas was used.

In this Example, the maximum value and maximum region value of the content of carbon atoms in the intermediate layer and surface protective layer were 60 atomic % and 90 atomic %, respectively, based on the total amount of constituent atoms. Distribution having a maximum value and a maximum region in the thickness direction of the amorphous-silicon layer and in which the maximum region value on the outermost surface protective layer side is largest as shown in FIGS. 9A and 9B was obtained by feeding source gas methane gas in order to incorporate carbon atoms.

The first upper-part charge injection blocking layer and the second upper-part charge injection blocking layer were each equally in a layer thickness of 0.2 $\mu$m, provided that, in this Example, the flow rate of the boron source diborane gas was changed to change the periodic-table Group 13 element (B: boron) content based on the total amount of constituent atoms contained in the first and second upper-part charge injection blocking layers, to produce negative-charging electrophotographic photosensitive members in which the state of distribution of two maximum values was changed as shown below.

Figure 9A:
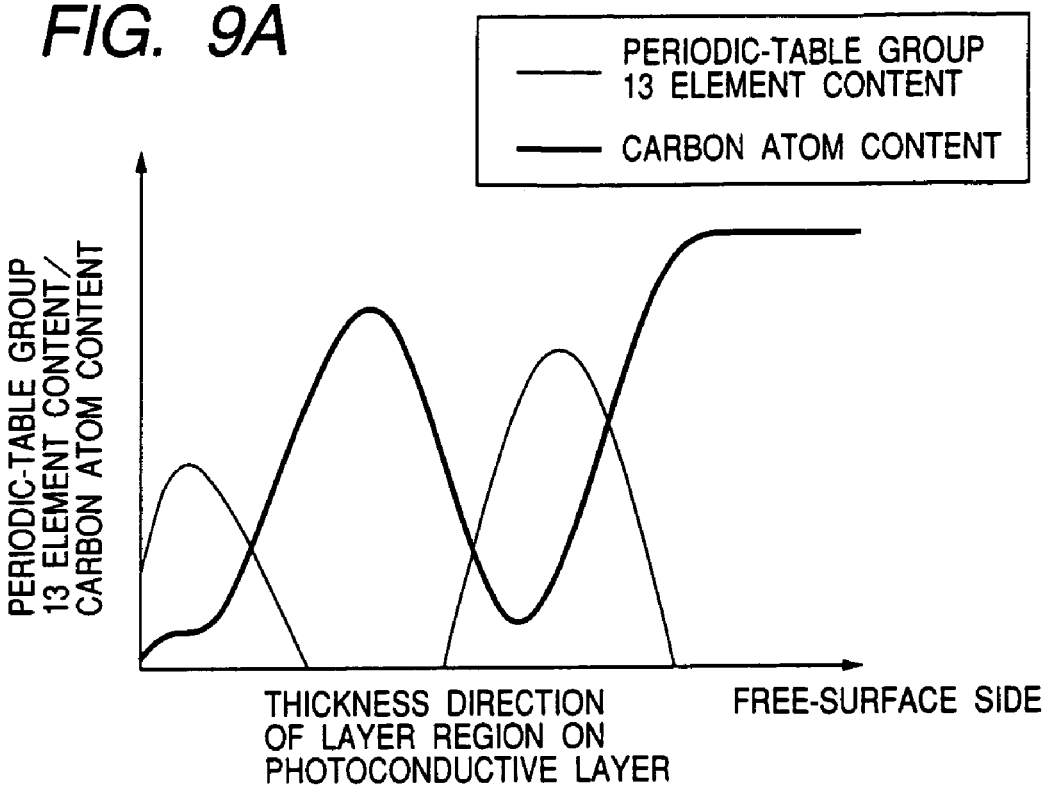
FIGS. 9A and 9B show distribution curves of the carbon atom content and periodic-table Group 13 element content in the thickness direction of an amorphous-silicon layer region of an a-Si photosensitive member of the present invention.

FIG. 9A: The state of distribution that the maximum value on the outermost surface protective layer side, of the periodic-table Group 13 element (B: boron) content based on the total amount of constituent atoms is largest.

Figure 9B:
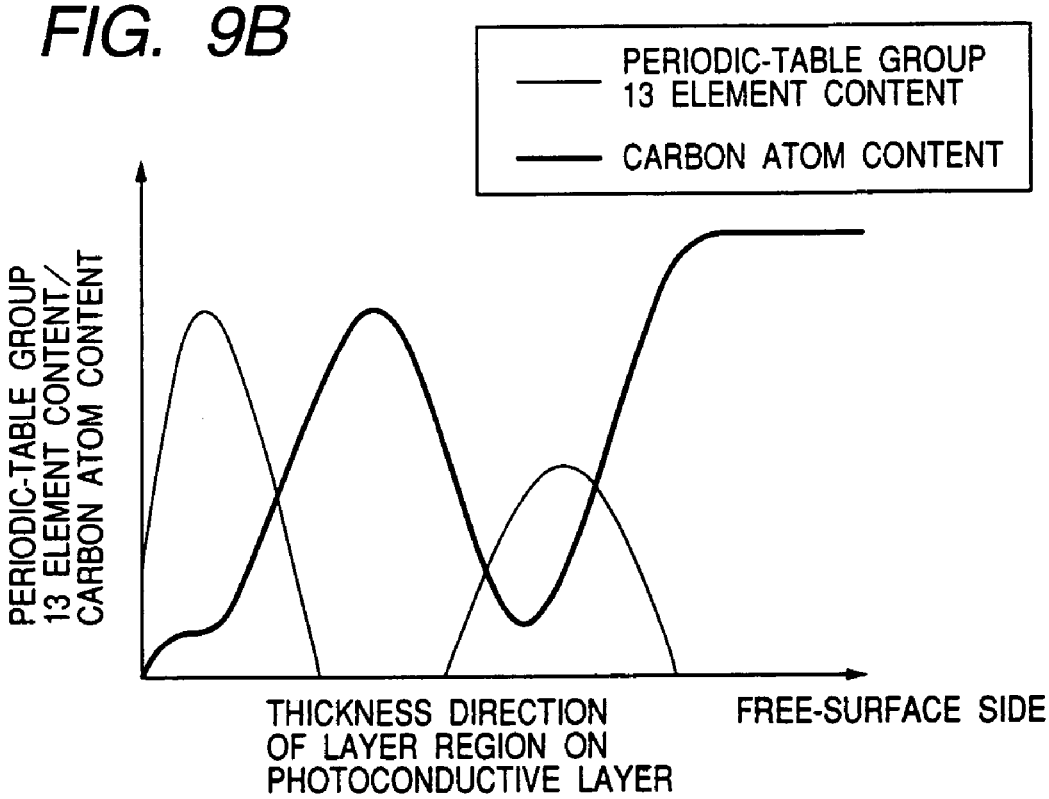

FIG. 9B: The state of distribution that the maximum value on the photoconductive layer side, of the periodic-table Group 13 element (B: boron) content based on the total amount of constituent atoms is largest.

The negative-charging electrophotographic photosensitive members produced in this Example were each set in an electrophotographic apparatus (a remodeled machine of iR6000, trade name, manufactured by CANON INC.; remodeled for evaluation in a negative-charging system) to make evaluation on the same evaluation items as those in Example B-1. The results of evaluation are shown in Table B-18.

TABLE B-18

| | Example B-9 | |
|---|---|---|
| | FIG. 9A | FIG. 9B |
| Smeared images: | A | A |
| Cleaning performance: | A | A |
| Depth of wear: | A | A |
| Melt-adhesion: | A | A |
| Pressure mar test: | A | A |
| Charging performance: | A | B |
| Sensitivity: | A | A |
| Overall evaluation: | AA | A |

As can be seen from the results shown in Table B-18, further good results are obtained on the evaluation item of charging performance when the periodic-table Group 13 element (B: boron) content distributed in the layer region deposited on the photoconductive layer is so distributed that its maximum value is largest on the outermost surface protective layer side.

As described above, in the electrophotographic photosensitive member according to the present invention, the content of the periodic-table Group 13 element contained in the layer region deposited on the photoconductive layer is made to have the distribution having at least any two of maximum value(s) and maximum region(s) in the thickness direction of the amorphous-silicon layer. This can provide a high-quality level electrophotographic photosensitive member which can be improved in charging performance, and also can overcome problems of occurrence of image defects due to pressure mars to elongate the lifetime of a-Si photosensitive members and can obtain good images over a long period of time.

In another embodiment, the layers are so constructed that the content of the carbon atoms based on the total amount of constituent atoms and the content of the periodic-table Group 13 element content based on the total amount of constituent atoms, contained in the layer region deposited on the photoconductive layer, have distribution having at least any two of maximum value(s) and maximum region(s) in the thickness direction of the amorphous-silicon layer, and that the maximum value(s) or maximum region(s) of the carbon atom content and the maximum value(s) or maximum region(s) of the periodic-table Group 13 element content are alternately distributed in the thickness direction of the layer region. This can provide a high-quality level a-Si photosensitive member which can obtain good images over a long period of time as having been improved in electrophotographic performance and having overcome the problems of image defects.

What is claimed is:

1. An electrophotographic photosensitive member comprising:

a conductive substrate; and a photoconductive layer on said substrate and containing at least an amorphous material composed chiefly of silicon atoms and, deposited on the photoconductive layer, a layer region containing an amorphous material composed chiefly of silicon atoms, which layer region contains at least partly an element selected from periodic-table Group 13;

wherein the distribution of the element selected from periodic-table Group 13 based on the total amount of constituent atoms in the layer region deposited on the photoconductive layer has at least any two of maximum value(s) and maximum region(s) in the thickness direction of the layer region.

2. The electrophotographic photosensitive member according to claim 1, wherein said member contains at least one atom selected from the group consisting of carbon atoms, oxygen atoms and nitrogen atoms in said amorphous-material-containing layer region deposited on said photoconductive layer.

3. The electrophotographic photosensitive member according to claim 1, wherein, in said amorphous-material-containing layer region deposited on said photoconductive layer, an outermost surface layer is formed of an amorphous material composed chiefly of silicon atoms and containing carbon atoms.

4. The electrophotographic photosensitive member according to claim 1, wherein, in said amorphous-material-containing layer region deposited on said photoconductive layer, the distance between any two of maximum value(s) and maximum region(s) adjacent to each other of the element selected from periodic-table Group 13 based on the total amount of constituent atoms is in the range of from 100 nm to 1,000 nm in the thickness direction of the layer region.

5. The electrophotographic photosensitive member according to claim 1, wherein, in said amorphous-material-containing layer region deposited on said photoconductive layer, the content of the element selected from periodic-table Group 13 based on the total amount of constituent atoms has a maximum value or maximum region value of 100 atomic ppm or more, and has a minimum value of 50 atomic ppm or less which is present between any two of maximum value(s) and maximum region(s) adjacent to each other.

6. The electrophotographic photosensitive member according to claim 1, wherein, in said amorphous-material-containing layer region deposited on said photoconductive layer, a maximum value or maximum region value positioned on the outermost surface side is largest among the maximum value(s) and maximum region value(s) of the content of the element selected from periodic-table Group 13 based on the total amount of constituent atoms.

7. An electrophotographic photosensitive member comprising:

a conductive substrate; and a photoconductive layer containing at least an amorphous material composed chiefly of silicon atoms and, deposited on said photoconductive layer, a layer region containing an amorphous material composed chiefly of silicon atoms, which layer region contains at least partly an element selected from periodic-table Group 13 and carbon atoms, wherein the content of the carbon atoms based on the total amount of constituent atoms in the layer region deposited on said photoconductive layer has distribution having at least any two of maximum value(s) and maximum region(s) in the thickness direction of the layer region.

8. The electrophotographic photosensitive member according to claim 7, wherein, in said amorphous-material-containing layer region deposited on said photoconductive layer, an outermost surface layer is formed of an amorphous material composed chiefly of silicon atoms and containing carbon atoms.

9. The electrophotographic photosensitive member according to claim 7, wherein, in said amorphous-material-containing layer region deposited on said photoconductive layer, the carbon atom content based on the total amount of constituent atoms has a maximum value or maximum region value in the range of from 40 atomic % to 95 atomic %.

10. The electrophotographic photosensitive member according to claim 7, wherein, in said amorphous-material-containing layer region deposited on said photoconductive layer, the distance between any two of maximum value(s) and maximum region(s) adjacent to each other of the carbon atom content based on the total amount of constituent atoms is in the range of from 100 nm to 3,000 nm.

11. The electrophotographic photosensitive member according to claim 7, wherein, in said amorphous-material-containing layer region deposited on said photoconductive layer, a maximum value or maximum region value positioned on the outermost surface side is largest among the maximum value(s) and maximum region value(s) of the carbon atom content based on the total amount of constituent atoms.

12. The electrophotographic photosensitive member according to claim 7, wherein, in said amorphous-material-containing layer region deposited on said photoconductive layer, the content of the element selected from periodic-table Group 13 based on the total amount of constituent atoms has a distribution having at least any two of maximum value(s) and maximum region(s) in the thickness direction of the layer region.

13. The electrophotographic photosensitive member according to claim 7, wherein, in said amorphous-material-containing layer region deposited on said photoconductive layer, the distance between any two of maximum value(s) and maximum region(s) adjacent to each other of the content of the element selected from periodic-table Group 13 based on the total amount of constituent atoms is in the range of from 100 nm to 1,000 nm.

14. The electrophotographic photosensitive member according to claim 7, wherein, in said amorphous-material-containing layer region deposited on said photoconductive layer, the content of the element selected from periodic-table Group 13 based on the total amount of constituent atoms has a maximum value or maximum region value of 100 atomic ppm or more, and has a minimum value of 50 atomic ppm or less which is present between any two of maximum value(s) and maximum region(s) adjacent to each other.

15. The electrophotographic photosensitive member according to claim 7, wherein, in said amorphous-material-containing layer region deposited on said photoconductive layer, a maximum value or maximum region value positioned on the outermost surface side is largest among the maximum value(s) and maximum region value(s) of the content of the element selected from periodic-table Group 13 based on the total amount of constituent atoms.

16. The electrophotographic photosensitive member according to claim 7, wherein, in said amorphous-material-containing layer region deposited on said photoconductive layer, the maximum value(s) or maximum region(s) of the carbon atom content based on the total amount of constituent atoms and the maximum value(s) or maximum region(s) of the content of the element selected from periodic-table Group 13 based on the total amount of constituent atoms are alternately distributed in the thickness direction of the layer region.

* * * * *

UNITED STATES PATENT AND TRADEMARK OFFICE

CERTIFICATE OF CORRECTION

PATENT NO. : 6,991,879 B2
APPLICATION NO. : 10/636691
DATED : January 31, 2006
INVENTOR(S) : Kazuto Hosoi et al.

It is certified that error appears in the above-identified patent and that said Letters Patent is hereby corrected as shown below:

COLUMN 4:
Line 38, "any" should read --for any--.
Line 43, "have" should read --has--.

COLUMN 5:
Line 33, "come" should read --become--.

COLUMN 20:
Line 1, "substrates" should read --substrate--.

COLUMN 31:
Line 35, "the the" should read --the--.

COLUMN 40:
Line 19, "seared" should read --smeared--.

Signed and Sealed this

Fifteenth Day of August, 2006

JON W. DUDAS
*Director of the United States Patent and Trademark Office*